US007789277B2

(12) United States Patent
Baughman et al.

(10) Patent No.: US 7,789,277 B2
(45) Date of Patent: Sep. 7, 2010

(54) CLOSURE ASSEMBLY HAVING A SPOUT WITH A THICKER BAND FOR SPOUT DIRECTING

(75) Inventors: Gary M. Baughman, Auburn, IN (US); Lynn A. Brooks, Auburn, IN (US)

(73) Assignee: Rieke Corporation, Auburn, IN (US)

( * ) Notice: Subject to any disclaimer, the term of this patent is extended or adjusted under 35 U.S.C. 154(b) by 0 days.

(21) Appl. No.: 12/436,984

(22) Filed: May 7, 2009

(65) Prior Publication Data

US 2009/0212079 A1 Aug. 27, 2009

Related U.S. Application Data

(63) Continuation-in-part of application No. 11/423,630, filed on Jun. 12, 2006, now Pat. No. 7,614,530.

(51) Int. Cl.
*B67D 3/00* (2006.01)

(52) U.S. Cl. ..... 222/529; 222/530; 222/541.9

(58) Field of Classification Search ..... 222/526–530, 222/541.9

See application file for complete search history.

(56) References Cited

U.S. PATENT DOCUMENTS

| | | | | |
|---|---|---|---|---|
| 2,561,596 | A | 7/1951 | Rieke | |
| 3,604,740 | A | 9/1971 | Summers | 292/256.61 |
| 3,613,966 | A | 10/1971 | Summers | 222/529 |
| 4,236,629 | A | 12/1980 | Dwinell | 222/529 |
| 4,294,382 | A | 10/1981 | Summers et al. | 222/529 |
| 4,320,861 | A | 3/1982 | Rieke et al. | 222/541 |
| 4,555,048 | A | 11/1985 | Hamman et al. | 222/478 |
| 4,568,006 | A | 2/1986 | Mueller et al. | 222/488 |
| 4,618,078 | A * | 10/1986 | Hamman et al. | 222/478 |
| 4,632,282 | A | 12/1986 | Nagashima | 222/529 |
| 4,699,290 | A | 10/1987 | Adams | 220/258 |
| 4,718,553 | A | 1/1988 | Adamoli et al. | 206/459 |
| 4,801,031 | A | 1/1989 | Barriac | 215/252 |
| 4,805,791 | A | 2/1989 | Begley | 215/252 |
| 4,877,143 | A | 10/1989 | Travisano | 215/230 |
| 4,921,147 | A | 5/1990 | Poirier | 222/527 |
| 4,981,230 | A | 1/1991 | Marshall et al. | 215/252 |

(Continued)

FOREIGN PATENT DOCUMENTS

| | | |
|---|---|---|
| DE | 38 05 648 A1 | 9/1989 |

(Continued)

*Primary Examiner*—Kevin P Shaver
*Assistant Examiner*—Andrew P Bainbridge
(74) *Attorney, Agent, or Firm*—Woodard, Emhardt, Moriarty, McNett & Henry LLP

(57) ABSTRACT

A closure assembly for a container, the container including a raised outlet defining a dispensing opening, includes a closure body having a nestable and extendable spout formed with a generally cylindrical section, a frustoconical section, and a transitioning region, including an invertible fold, located between these two sections so as to enable the closure body to be either nested or extended. The generally cylindrical section defines an outlet opening and a threaded closing cap is assembled to the generally cylindrical section for closing off the outlet opening. A retainer is used for connecting the closure body to the raised outlet wall and the frustoconical section includes a thicker wall portion for enabling the spout to maintain a selected orientation upon deflection into the selected orientation in order to provide directional discharge of the container contents.

20 Claims, 21 Drawing Sheets

U.S. PATENT DOCUMENTS

| | | | | |
|---|---|---|---|---|
| 5,035,341 | A | 7/1991 | Heilman et al. | 215/230 |
| 5,096,079 | A | 3/1992 | Odet | 215/252 |
| 5,641,099 | A | 6/1997 | McLelland et al. | 222/530 |
| 5,722,570 | A | 3/1998 | Sultzer, III et al. | 222/529 |
| 5,788,100 | A | 8/1998 | Sturk | 215/258 |
| 5,899,364 | A | 5/1999 | McLelland et al. | 222/153.06 |
| 5,967,376 | A | 10/1999 | McLelland et al. | 222/153.06 |
| 6,135,985 | A | 10/2000 | Fromer | 604/295 |
| 6,193,921 | B1 | 2/2001 | Nelson | 264/328.1 |
| 6,641,007 | B2 * | 11/2003 | Chung et al. | 222/529 |
| 2005/0274815 | A1 | 12/2005 | Bergholtz et al. | 239/16 |

FOREIGN PATENT DOCUMENTS

| | | | |
|---|---|---|---|
| EP | 0 221 419 | A2 | 5/1987 |
| EP | 0 161 746 | B1 | 4/1989 |
| EP | 0 432 059 | B1 | 6/1993 |
| FR | 2 578 819 | A1 | 9/1986 |
| GB | 1 270 086 | A | 4/1972 |
| GB | 2 055 772 | A | 3/1981 |
| GB | 2 121 374 | A | 12/1983 |
| WO | WO 00/34133 | A3 | 6/2000 |
| WO | WO 02/49931 | A1 | 6/2002 |

* cited by examiner

CLOSURE ASSEMBLY HAVING A SPOUT WITH A THICKER BAND FOR SPOUT DIRECTING

This application is a continuation-in-part of application Ser. No. 11/423,630, filed Jun. 12, 2006, now issued as U.S. Pat. No. 7,614,530, which is hereby incorporated by reference in its entirety.

BACKGROUND OF THE INVENTION

The present invention relates in general to container closures and closure assemblies that include a nestable and extendable spout. More specifically, the present invention relates to the addition of at least one thicker material section to the wall of the spout such that the spout can be deflected and set in a desired direction. When a single thicker material section is used, it can be positioned at different locations depending on the desired deflection orientation. When two thicker material sections are used, they can be used separately or in combination for a greater number of deflection options.

Container closures and closure assemblies of the type generally described herein often include some tamper-evident feature incorporating a plurality of frangible elements. One such product has been offered by Rieke Corporation of Auburn, Ind., under its FLEXSPOUT® trademark. This product includes a tamper-evident cap and a closure body with a nestable and extendable spout. The tamper-evident cap threads onto the threaded end of the spout and the cap must be removed in order to gain access to the contents of the container (drum) via the interior of the spout. In one arrangement the closure body is received by a raised surrounding (annular) wall that defines the container opening and when used on a metal drum end, the closure includes an annular retaining member that fits over an outer wall portion of the closure body and, by crimping, secures the outer wall portion to the surrounding wall that defines the container opening. In other arrangements that are suitable for the closure assembly of the present invention, different styles of containers and openings are used. The closure assembly construction further includes a series of frangible elements that connect a pair of bail handles that are used to extend the spout with the remainder of the cap. When a plastic drum or container receives a FLEXSPOUT® closure, the tamper-evident cap includes an outer annular portion that snaps over an outer wall portion of the closure body and secures the outer wall portion to the surrounding wall that defines the container opening. A series of frangible elements connects the outer annular portion of the tamper-evident cap with the remainder of the cap body, principally with a pair of bail handles that are used to extend the spout.

One feature of the present invention, as disclosed herein, is the addition of at least one thicker section of material as part of the extendable spout that functions as a "memory band" structure. This structure allows the extended spout to be flexed or bent in a desired direction and then stay in that selected orientation. When a vented closure is used, see U.S. Pat. No. 4,618,078, issued Oct. 21, 1986 to Hamman et al. as one example of a vented closure, the flexing or bending of the spout in a desired direction provides an added benefit. The bending or flexing of the spout into the desired direction for discharge of the contents of the container puts into play only those venting ears that are advantageous to the actual dispensing and takes the other venting ears out of play. This in turn yields a larger dispensing opening and therefore a faster flow rate for the outflow or dispensing of product from the container. The outflow of fluid product from the drum or container is still smoother (as compared to a non-vented closure) due to the fact that some of the venting ears are still used and these venting ears that are in play provide an adequate path and sufficient flow area for air based upon the exiting flow rate. Depending on the size and number of venting ears, it is possible for adjacent ears to display some degree of partial overlap. In the present disclosure, some overlap is shown, in part, with no overlap for other ears when the spout is deflected into a dispensing position. In order to preclude any overlap at any time, the individual ears can be made more narrow and their number increased. The number of venting ears and the width of each ear are two considerations. The length is also a consideration, but venting ear length goes more to the size of the flow opening that is defined by the ends of each venting ear when the spout is extended.

BRIEF SUMMARY

A closure assembly for a container, the container including a dispensing opening, according to one embodiment of the present invention, comprises a closure body including a nestable and extendable spout, the spout having a generally cylindrical section and a frustoconical section, and a transition region, including an invertible fold, located between the two sections, the generally cylindrical section defining an outlet opening, and a tamper-evident closing cap constructed and arranged for assembly to the spout for closing off the outlet opening. The frustoconical section includes a wall having a first wall thickness and at least one band portion with a second wall thickness that is greater than the first wall thickness, the thicker band portion being constructed and arranged for enabling the spout to maintain a selected orientation upon deflecting the spout into the selected orientation for directional discharge of container contents.

One object of the present invention is to provide an improved closure assembly for a container.

Related objects and advantages of the present invention will be apparent from the following description.

DETAILED DESCRIPTION

Figure 1:
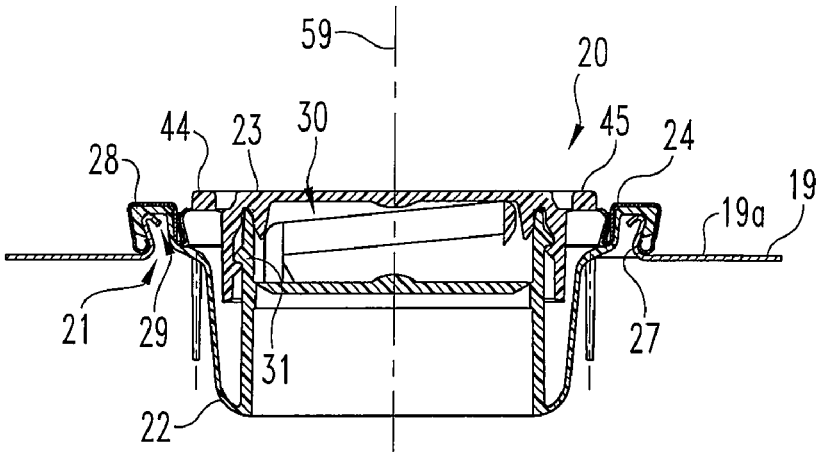
FIG. 1 is a front elevational view, in full section, of a closure assembly as assembled to a raised outlet of a container, according to a typical embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
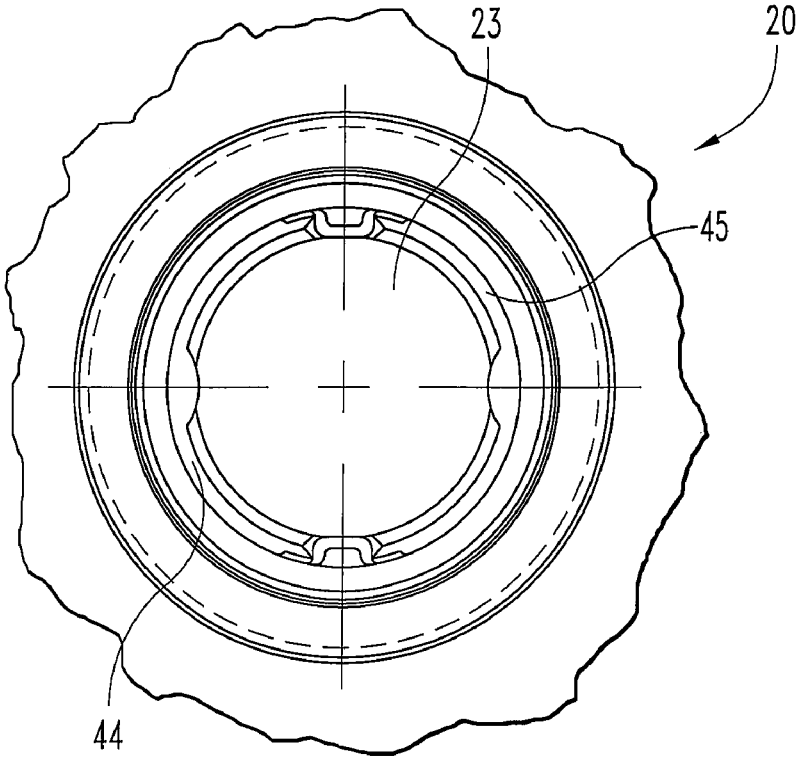
FIG. 2 is a complete top plan view of the entire FIG. 1 closure assembly.
Figure 3:
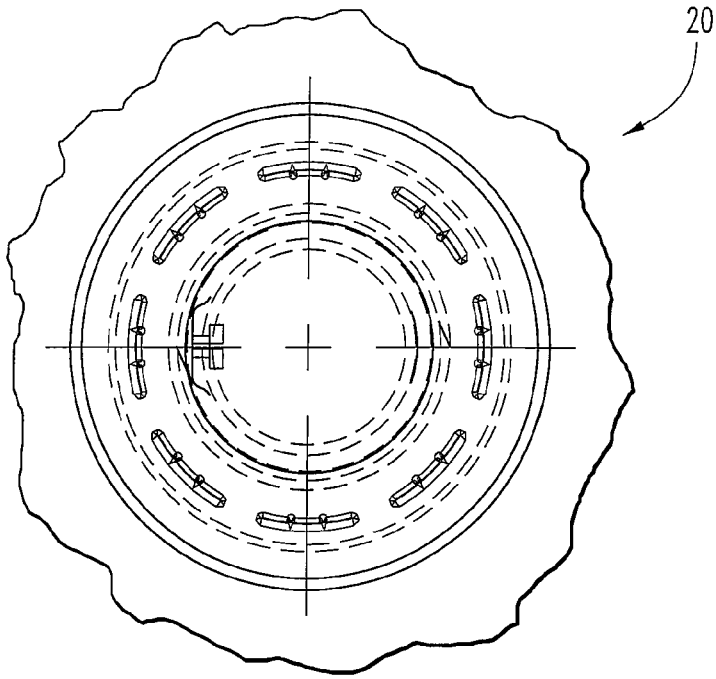
FIG. 3 is a complete bottom plan view of the entire FIG. 1 closure assembly.
Figure 4:
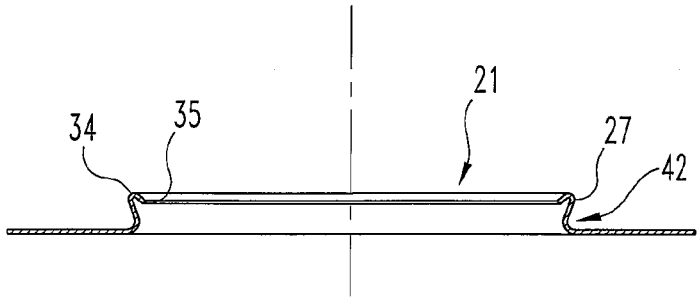
FIG. 4 is a front elevational view, in full section, of a raised container outlet wall defining an outlet opening of a metal container.
Figure 5:
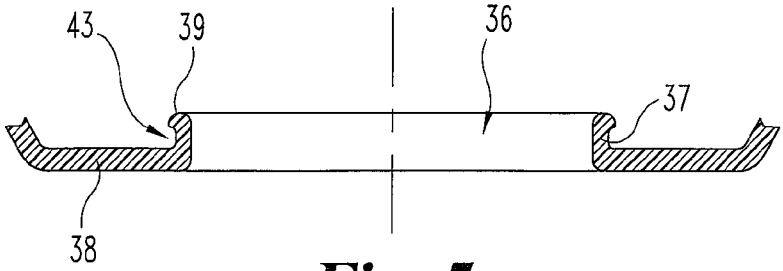
FIG. 5 is a front elevational view, in full section, of a raised container outlet wall defining an outlet opening of a plastic container.

Referring to FIGS. 1, 2, and 3, there is illustrated a closure assembly 20 according to the present invention. Closure assembly 20 is constructed and arranged for secure connection to or into an outlet opening defining structure whether a raised annular outlet wall or a container opening edge or some other opening configuration. The defined outlet opening is positioned within the end of a corresponding container or drum 19. The upper surface 19*a* of container end 19 is planar and surrounds the raised annular outlet wall or container opening, depending on the particular construction. The raised outlet wall defining the outlet opening of a metal drum end is illustrated in FIG. 4. The raised outlet wall defining the outlet opening of a plastic drum end is illustrated in FIG. 5. For the FIG. 1 illustration, the raised metal drum end outlet wall that defines outlet opening 21 has been selected.

Figure 6:
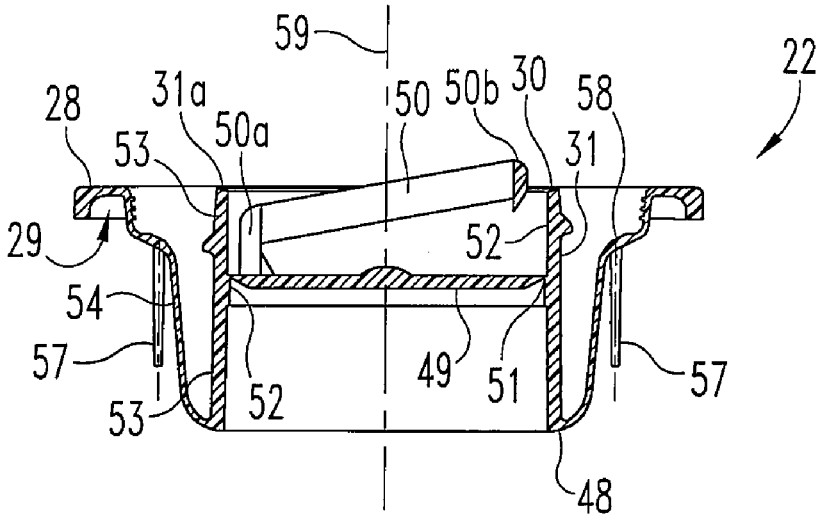
FIG. 6 is a front elevational view, in full section, of a closure body comprising one component part of the FIG. 1 closure assembly according to the present invention.
Figure 7:
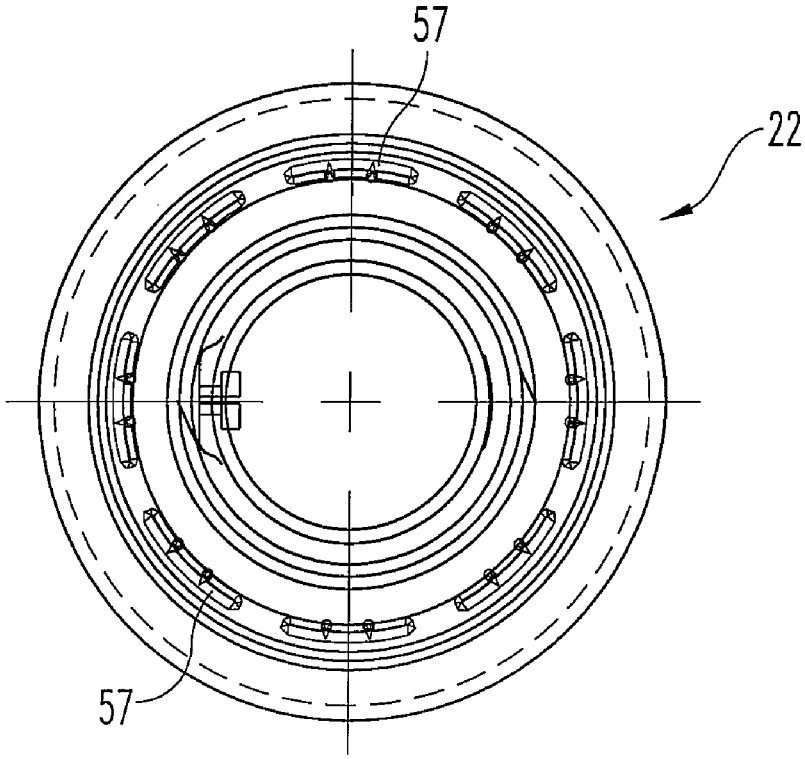
FIG. 7 is a complete top plan view of the entire FIG. 6 closure body.
Figure 8:
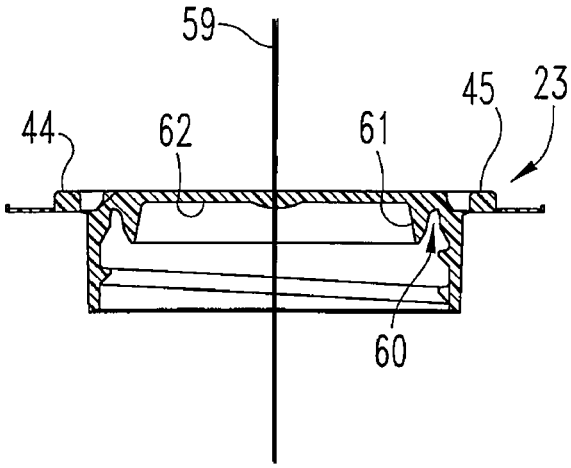
FIG. 8 is a front elevational view, in full section, of a tamper-evident closing cap comprising one component part of the FIG. 1 closure assembly.
Figure 9:
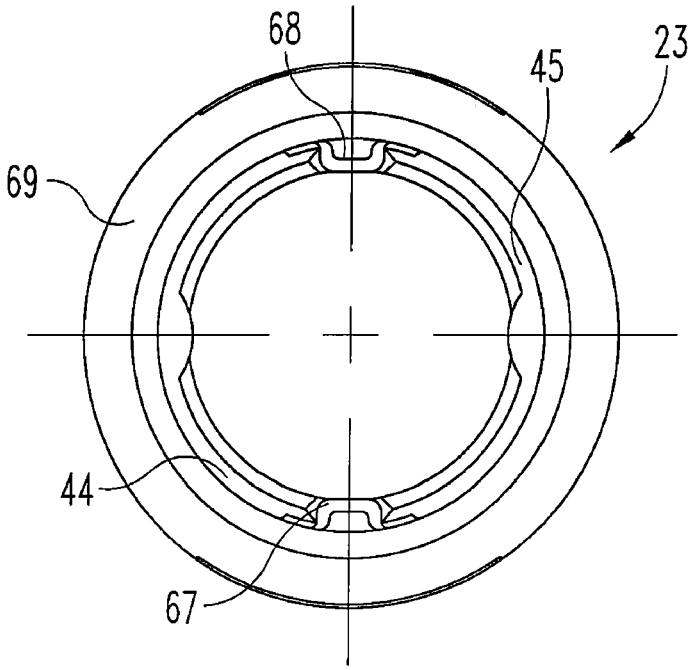
FIG. 9 is a complete top plan view of the entire FIG. 8 tamper-evident closing cap.
Figure 10:
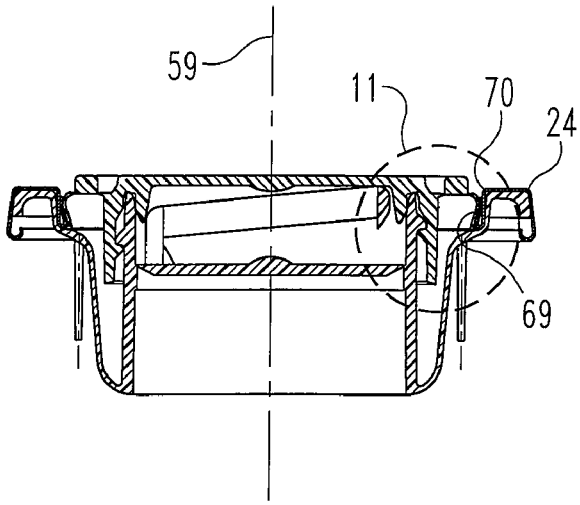
FIG. 10 is a front elevational view, in full section, of the FIG. 1 closure assembly without the FIG. 1 container.
Figure 11:
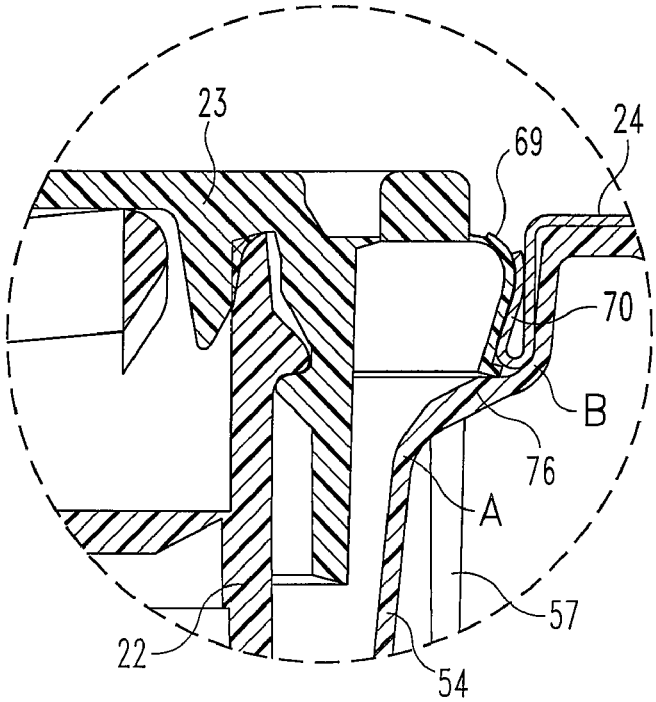
FIG. 11 is an enlarged, front elevational view, in full section, of one portion of the FIG. 10 closure assembly.
Figure 12:
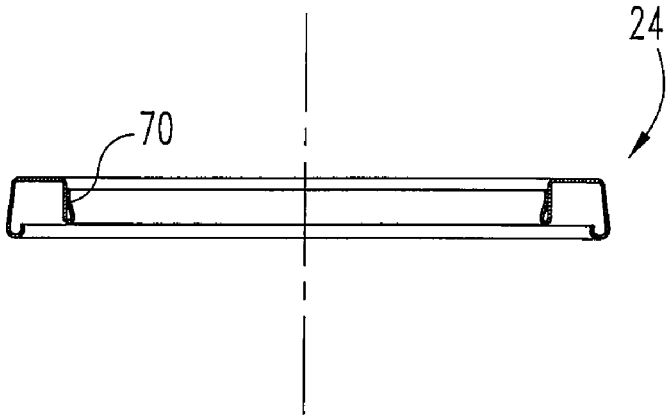
FIG. 12 is a front elevational view, in full section, of a retainer comprising one component part of the FIG. 1 closure assembly, according to the present invention.
Figure 13:
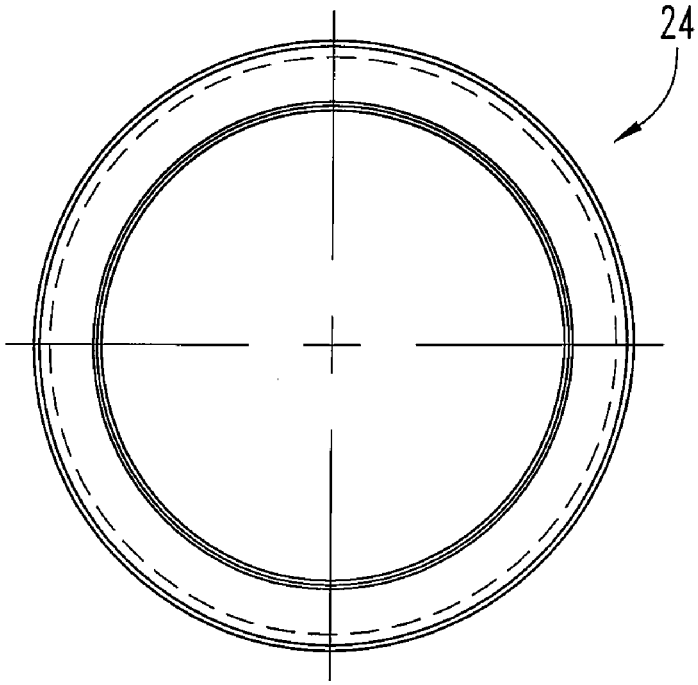
FIG. 13 is a complete top plan view of the entire FIG. 12 retainer.

Closure assembly 20 includes a closure body 22, tamper-evident closing cap 23, and annular metal retainer 24. Each of these three component parts constitutes a unitary component with the closure body 22 being molded out of plastic, tamper-evident closing cap 23 being molded out of plastic, and retainer 24 being formed as a unitary component out of metal. The details of the closure body 22 are illustrated in FIGS. 6 and 7. The details of the tamper-evident closing cap 23 are illustrated in FIGS. 8 and 9. The details of the metal retainer 24 are illustrated in FIGS. 12 and 13. Additionally, closure assembly 20 including closure body 22, closing cap 23, and retainer 24 is illustrated in FIGS. 10 and 11, without the container end or outlet opening. While the FIG. 11 illustration provides an enlarged detail, one point to be derived from the FIG. 10 illustration is that the closure assembly can be pre-assembled, as illustrated, and then applied to the raised outlet wall of the container end for crimping of the retainer so as to anchor the closure body to the outlet wall.

With continued reference to FIGS. 1, 2 and 3, and considering the prior remarks, it will be seen that closure assembly 20 assembles onto the formed and raised outlet wall 27 that defines outlet opening 21. The closure body 22 includes an annular outlet lip 28 formed with an inverted annular channel 29. The annular channel 29 fits over and around outlet wall 27, see FIG. 1. Once the closure body 22 and outlet wall 27 are assembled in this manner, noting that the annular metal retainer 24 is preassembled to the closure body, this positions the metal retainer 24 over and around the outer lip 28. The next step is to crimp the metal retainer 24 so as to securely and tightly clamp the outer lip 28 onto and around the outlet wall 27, creating a sealed interface and a secure annular connection.

The tamper-evident closing cap 23 is internally threaded and the dispensing end 30 of the nestable and extendable spout 31 of closure body 22 is externally threaded for receipt of the closing cap 23. The closing cap 23 can be threaded onto spout 31 either before or after the closure body is crimped onto outlet wall 27 by the use of metal retainer 24. However, in terms of an initial subassembly of closure assembly 20 with its three component parts, the metal retainer 24 would be preassembled onto the closure body.

Referring to FIGS. 4 and 5, the raised outlet wall 27 that defines outlet opening 21 includes a curved upper edge 34 and a depending inner lip 35. The annular channel 29 has a compatible interior geometry relative to the curvature of edge 34 and this facilitates the crimping operation using the metal retainer 24. In FIG. 5, the outlet opening 36 is defined by raised outlet wall 37. The unitary plastic construction of the outlet wall 37 and drum (or container) end 38 provides the curved upper edge 39 by means of its molding process. When a plastic drum is being used, one alternative design is to modify the tamper-evident cap with an outer annular portion that snaps over the combination of the closure body and outlet wall. This outer annular portion of the cap replaces the metal retainer 24.

With continued reference to FIGS. 4 and 5, the outlet wall 27 is formed with an undercut or relief 42 below the curved upper edge. A similar relief 43 is molded into outlet wall 37. These reliefs 42 and 43 provide a clearance space for the movement of material of the annular channel 29 as the crimping operation applied to the metal retainer 24 takes place. These reliefs 42 and 43 also help to prevent any chance of pulling the closure body 22 off of the raised outlet wall 27 as the closure body spout 31 is extended from its nested orientation by pulling upwardly in an axial direction the bail handles 44 and 45 of the closing cap 23.

Figure 18:
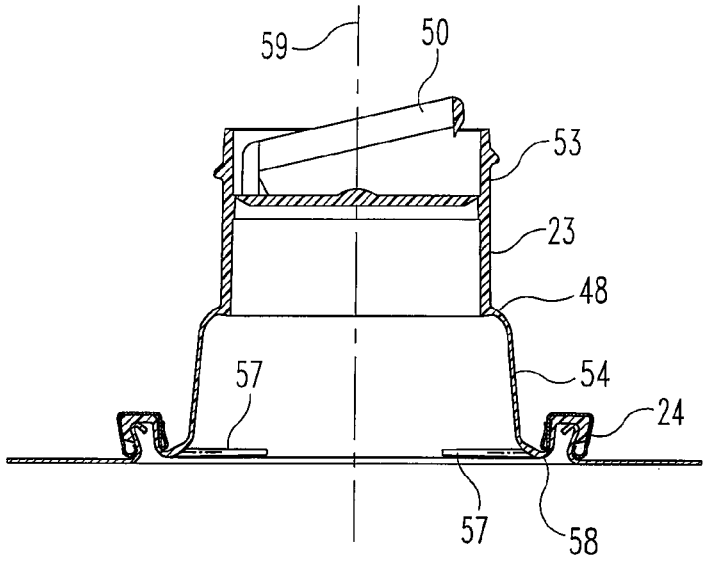
FIG. 18 is a front elevational view, in full section, of the FIG. 1 closure assembly with the tamper-evident closing cap removed and the closure body extended.

Referring now to FIGS. 6 and 7 and with continued reference to FIGS. 1, 2 and 3, closure body 22 includes an invertible fold 48 that reverses its orientation when changing the closure body from a nested orientation (see FIG. 6) to an extended orientation (see FIG. 18). Closure body 22 also includes a tear-out diaphragm 49 with a unitary pull ring 50. A weakened annular score line 51 or an annular severable membrane surrounds the diaphragm 49 and connects the outer edge of the diaphragm to the inner surface 52 of the spout 31. The pull ring 50 is joined to one edge portion of diaphragm 49 and by pulling upwardly on ring 50, the diaphragm 49 is able to be torn out of the interior of spout 31. This tearing out is accomplished by causing the annular score line (or membrane) to sever. As an alternative to the use of pull ring 50, this diaphragm could be cut free from its unitary connection with spout 31. However, the use of pull ring 50 is believed to be preferred and, due to the weakened score line or membrane, continued pulling on ring 50 causes the entire diaphragm 49 to separate from within spout 31. The unitary molding of closure assembly 20 includes the unitary construction of pull ring 50 and diaphragm 49. This molding of a suitable plastic material is performed in a manner that positions the connecting post 50*a* of the pull ring 50 with a generally vertical orientation. The mold design also orients the pull ring 50 with a slight incline. Based in part on where the diaphragm 49 is placed axially within spout 31 and based in part on the angle of incline of pull ring 50 and based in part on the height of post 50*a*, the free end 50*b* of pull ring 50 extends above the upper edge 31*a* of spout 31. When the tamper-evident cap 23 (see FIGS. 8 and 9) is threaded onto the spout 31, the upper edge 31*a* pushes into annular channel 60 with a snug fit. The thickness of the cylindrical section 53 relative to the radial width of channel 60 causes flexible wall 61 to flex and apply pressure to the inner surface 52 of spout 31 (see FIG. 1).

Figure 20:
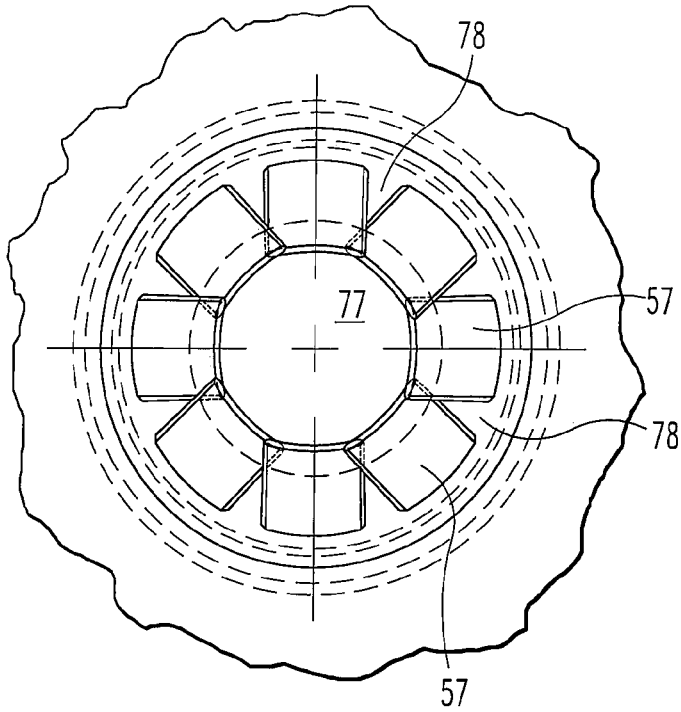
FIG. 20 is a complete bottom plan view of the entire FIG. 19 closure assembly with its venting ears deployed.

The spout 31 can be considered as having two sections, an inner, generally cylindrical section 53 and an outer, frusto-conical section 54. These two sections are separated by the invertible fold 48. The outer section 54 includes a series of venting ears 57 that are positioned at fold 58 and depend in an axially downward direction when the closure body 22 is in its nested orientation. When the closure body 22, specifically the spout 31, is extended, the fold 58 moves and flips the venting ears 57 into a lateral orientation, see FIG. 18. As illustrated in FIG. 20, a wider style of eight (8) venting ears 57 results in the corners of adjacent ears overlapping when the spout is extended. Depending on the movement and interaction of adjacent venting ears as the spout is directed to a dispensing orientation, referring now to FIGS. 21-23, and the "directional" spout that is illustrated therein, it may be desirable that the venting ears not interact with each other. It is therefore envisioned that a larger number of venting ears, where each ear has a more narrow construction as compared to its predecessor, would address this particular aspect of ear-to-ear contact interaction or interference. By using a larger number of more narrow venting ears, it is possible to prevent any overlap of venting ears 57. In terms of the directions referenced herein, FIG. 1 represents the typical, upright orientation and centerline 59 represents the longitudinal axis through the geometric center of the closure assembly 20. As used herein, an axial direction is parallel to centerline 59 and a lateral direction is perpendicular to centerline 59.

When the tamper-evident closing cap 23 is fully threaded onto spout 31, the inner surface 62 pushes down on the free end 50*b* of the pull ring 50. However, due to the elastic properties of the plastic used for the closure body 22, once the tamper-evident closing cap 23 is removed, the pull ring 50 flexes (pivots) upwardly so that the free end 50*b* is returned to its free state, slightly above the upper edge 31*a* of spout 31, as illustrated in FIG. 6. The illustrated free state of pull ring 50 orients the free end 50*b* slightly above upper edge 31*a*. By positioning the diaphragm 49 at its illustrated location and by the construction and arrangement of the pull ring 50, the pull ring is more accessible and easier to grasp when compared to earlier designs that recess the diaphragm and pull ring farther down (axially) into the spout.

Closing cap 23 includes, as part of its unitary, molded plastic construction, a pair of oppositely-disposed bail handles 44 and 45. Each bail handle 44 and 45 is joined to the remainder of the closing cap 23 by living hinge 67 and 68, respectively. As initially configured, prior to any opening of the closure assembly, the bail handles 44 and 45 lay substantially flat (planar) and the geometric plane in which they lay is substantially parallel with the planar upper surface 19*a* of the container end. Surrounding the bail handles 44 and 45 and unitarily joined therewith as part of the molded plastic construction of cap 23 is an arcuate, flexible "warning" flap 69. Flap 69 is constructed and arranged for a message to be screened, embossed, or otherwise marked in some fashion, depending on the intended use and circumstances relating to closure assembly 20. Since it may be possible to provide a suitable closure assembly with only one bail handle, the flexible "warning" flap is described as being arcuate in form. It is though contemplated by the present invention that, with the use of two bail handles forming a substantially annular ring around the closing cap 23, the flap 69 would be generally annular in shape. A further option is to configure flap 69 into two similar arcuate sections of approximately 180 degrees, or slightly less, each.

Figure 14:
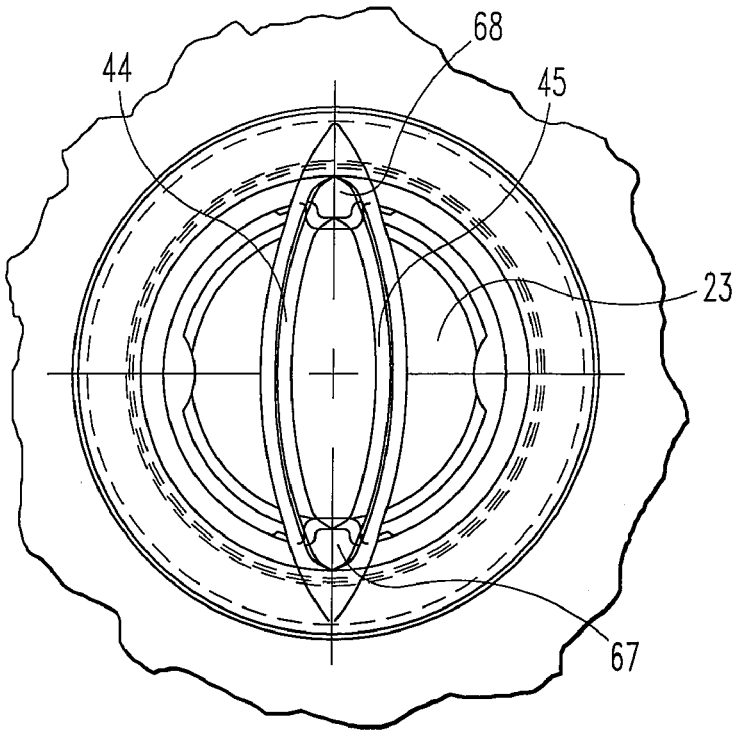
FIG. 14 is a top plan view of the FIG. 1 closure assembly with a pair of bail handles illustrated in a lifted orientation.
Figure 15:
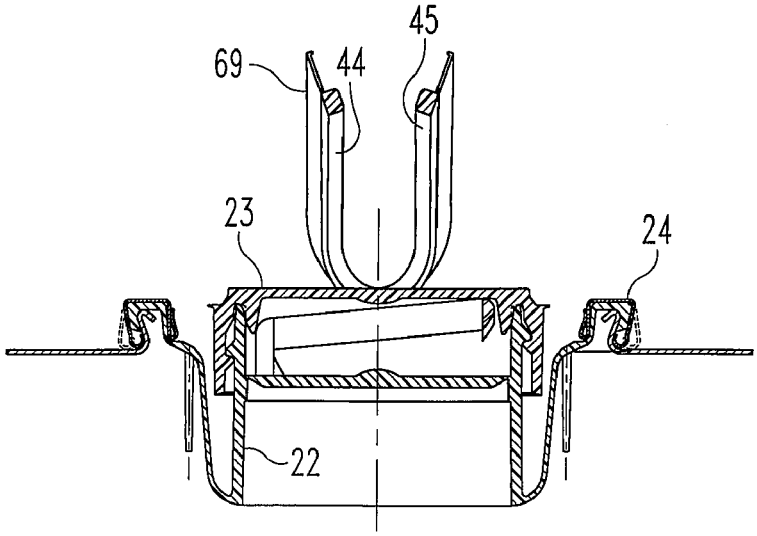
FIG. 15 is a front elevational view, in full section, of the FIG. 14 closure assembly with the lifted bail handles.

Flap 69, whether as an annular form or as an arcuate section, or as two arcuate sections, is initially deflected and tucked down into the space between the bail handles and the metal retainer 24, up against the annular inner wall 70 of the metal retainer 24, as illustrated in FIGS. 10 and 11. In this deflected, tucked, and inserted condition, whatever writing or marking or embossment may be displayed on the upper surface of flap 69, that information will not be visible and, for the most part, flap 69 is not visible except for a small portion that is shown as connecting (unitarily) to the corresponding bail handle. However, when the bail handles 44 and 45 are lifted, see FIGS. 14 and 15, the flap 69 deploys and not only the flap, but the upper surface of the flap becomes visible. This means that the end user can read whatever message, information, or warning has been placed on the upper surface of the flap and it is intended that this upper surface would be used for a warning and as an alert to advise the end user that a tampering attempt may have occurred if the flap 69 is deployed. This is why the flap 69 is described as being a tamper-evident, deployable flap.

While the deployment of flap 69, even without any markings, writings, or message, would still indicate an attempt to tamper with the container contents, or at least an attempt to open the closure assembly, the addition of some type of warning or alert message directly onto the flap provides an added reminder to the end user and helps to reinforce the understanding that, if the flap 69 is out of its tucked or inserted condition, the end user should be aware that someone, at some time "upstream", lifted the bail handles and the only reason to do so would be an attempt to open the closure assembly. The use of flap 69 provides a different style of tamper evidencing and thus the reason to select the term "warning" in describing the construction and use of flap 69. The intended message is some type of statement or explanation that if flap 69 is deployed, be careful when dispensing and using the contents of the container.

When the bail handles 44 and 45 are secured by some type of frangible element connection, that style of connection could serve as another indicator of a tampering attempt. However, that tamper-evident technique would typically not be as visible and not as pronounced as the use of flap 69. Further, some of the products that are currently on the market as an imitation of the Rieke FLEXSPOUT® product may include broken frangible elements due to the manner of construction and design and the presence of broken frangible elements when there has not been any tampering attempt tends to desensitize the end user to the significance of the frangible elements. Preferably frangible elements are not used for either of the bail handles 44 and 45.

The tear-out diaphragm 49 can also serve as another indicator of a tampering attempt if the end user knows and can always remember that the tear-out diaphragm 49 should be present on the interior of spout 31 and should be completely secured to the spout around its entire inside diameter. Even with these alternatives for tamper indicating measures, the use of warning flap 69 is believed to be preferred in that the only way to actually defeat flap 69 is to cut it off completely and with a near perfect, completely smooth edge. That becomes a very difficult, if not virtually impossible task, considering the size, shape, and material of flap 69 and the time and tools available to the individual considering a tampering attempt. Even if the end user may not know or recall that a warning flap should be present, a jagged cut edge will certainly put that end user on notice that something is wrong, or at least may be wrong.

Figure 16:
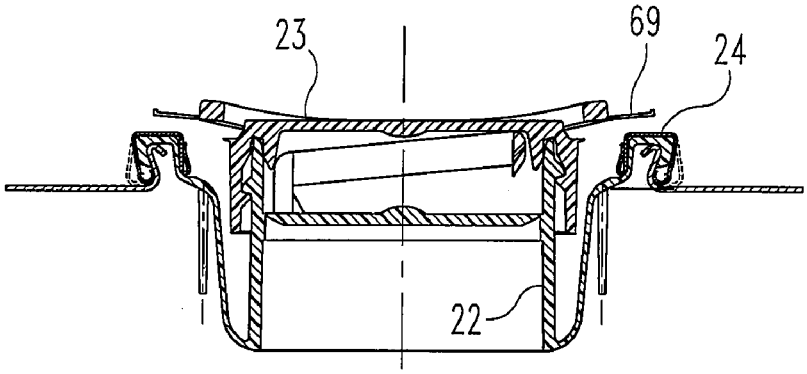
FIG. 16 is a front elevational view, in full section, of the FIG. 14 closure assembly after the bail handles have been released from the lifted orientation.
Figure 17:
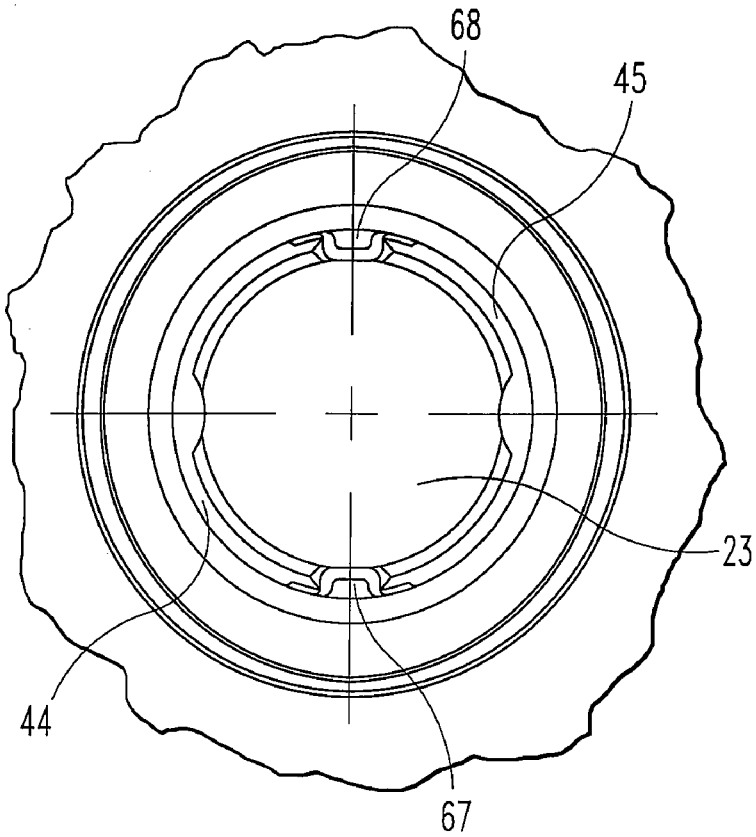
FIG. 17 is a complete top plan view of the entire FIG. 16 closure assembly showing a tamper-evident flap in a deployed or untucked position.

In use, whether or not the bail handles 44 and 45 are each secured in a down and flush orientation by a frangible element, the living hinge and the initially molded condition positions the bail handles down and generally flush with the upper surface of the tamper-evident closing cap 23. The planar orientation of the two bail handles positions them in a geometric plane that is substantially parallel with upper surface 19*a*. However, when the bail handles are lifted as the only effective way to either remove the closing cap 23 and/or extend spout 31, the living hinges 67 and 68 experience a slight plastic deformation. This causes the bail handles 44 and 45 to remain slightly raised, see FIG. 16, even after releasing the lifting bail handles and threading the closing cap 23 back onto spout 31 and/or after nesting spout 31. If there was an attempt to try and refold or reinsert flap 69 back into its initial FIG. 1 or FIG. 11 condition, the set or deformation experienced by the living hinges for bail handles 44 and 45 still returns those bail handles to the raised FIG. 16 orientation and this pulls the flap 69 out of its tucked or inserted condition, thereby continuing to expose the flap and the upper surface of flap 69 including any message or writing thereon. Even if the design of the bail handles and the living hinges, and considering the selection of plastic, would enable the bail handles to return to a planar condition, it would still not be possible to re-tuck the deployable flap(s). The thought here is that the circular form of the flap or arcuate form of the flap sections, considering the elasticity of plastic, would prevent someone from re-folding and re-tucking the flap or flaps back into their starting orientation.

Figure 21:
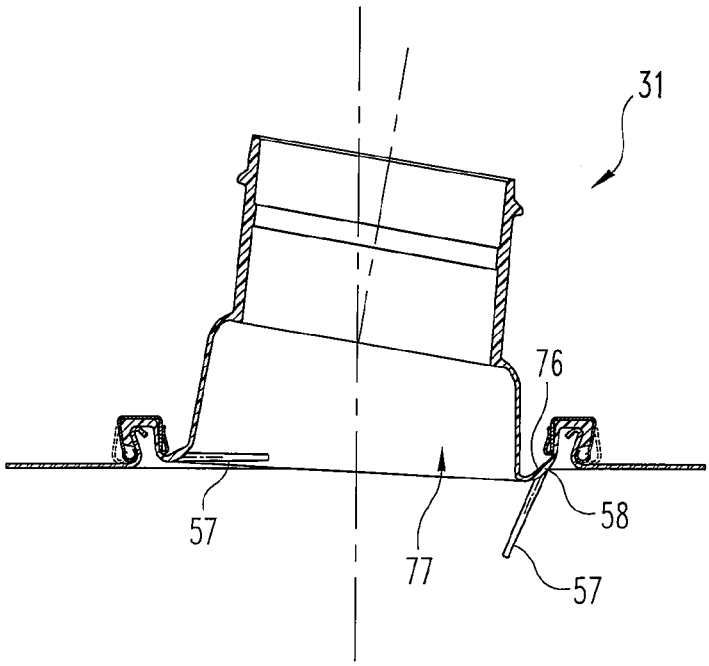
FIG. 21 is a front elevational view, in full section, of the FIG. 1 closure body flexed into a desired direction for dispensing of the container contents.

Another feature of the present invention can best be seen in the enlarged detail of FIG. 11. The area or portion of the frustoconical section 54 that has been referenced as fold 58 has a thicker wall for that portion 76 generally between points A and B. As shown, point A generally coincides with a concave bend in section 54 or at least the start of the bend, as viewed from the exterior of closure body 22. Point B generally coincides with a convex bend in section 54, as viewed from the exterior of closure body 22. Fold 58 includes both bends and portion 76. This thicker wall portion or annular band 76, by design, coincides with the location where the venting ears 57 are positioned. The wall thickness of portion 76 is approximately twice the wall thickness of the spout portions adjacent to portion 76. Considering the annular form of portion 76, is has the appearance of a thicker band and that description is also used herein. Referring now to FIGS. 19-23, the importance of the thicker wall portion 76 will be explained. First, this thicker wall portion 76 permits the extended spout 31 to be flexed so as to point it in a desired dispensing direction and generally remain in that selected orientation. The principle of the mechanism, is similar to a flexible straw, such as those straws used in hospitals. The shape of the spout wall in combination with the properties of the plastic and its relative wall thickness cause the spout 31 to remain in its flexed or deflected desired orientation, as illustrated in FIG. 21. When the spout is pushed or pulled in the desired direction for dispensing, the thicker band 76 offsets stresses in the frustoconical section 54 which typically cause a symmetric extended condition. This off-setting or overriding is caused by thicker section 76 material strength and the adjacent material or spout body material "break-over" into a lower stress condition similar to a spiral twisted annular belt or "rubber band". To completely describe this process, the band has a near neutral stress condition when the spout is extended axially. During repositioning the spout away from the "natural" axis, a higher unstable stress condition exists in the band and adjacent areas. As the spout is redirected further, it passes through a break-over condition and the stress again stabilizes in a lower neutral condition. This condition is a three dimensional stress condition similar to common two dimensional self-closing plastic hinge designs which orient in either the open or closed position and will not maintain or stabilize in a partially open or closed position. Considering the principles of elastic and plastic deformation and set, it will be noted that the redirected, near neutral, axis registers to the side of the spout, due to this deflection, off of the axial centerline 59. The end user, prior to dispensing contents from the container, simply needs to manually push the spout 31 in the desired direction for dispensing and the construction and arrangement of that thicker section, considering the overall geometry and the type of plastic as well as the thicker wall, causes the spout to remain in that selected orientation.

As used herein, the reference to "deflection" means that the spout or the portion or section of the spout that is being deflected into a desired or selected dispensing orientation will stay in that orientation until moved manually to another orientation. The branding terminology that has been adopted for the thicker wall portion 76 is "memory band".

There is a benefit to be realized from simply being able to direct the spout 31 and have it maintain that selected orientation. By remaining in the desired (selected) orientation for dispensing contents from the container, the end user can control the dispensing direction, see FIG. 23. If there was nothing more, this directional capability would be seen as a novel and unobvious advance in the closure art.

Figure 19:
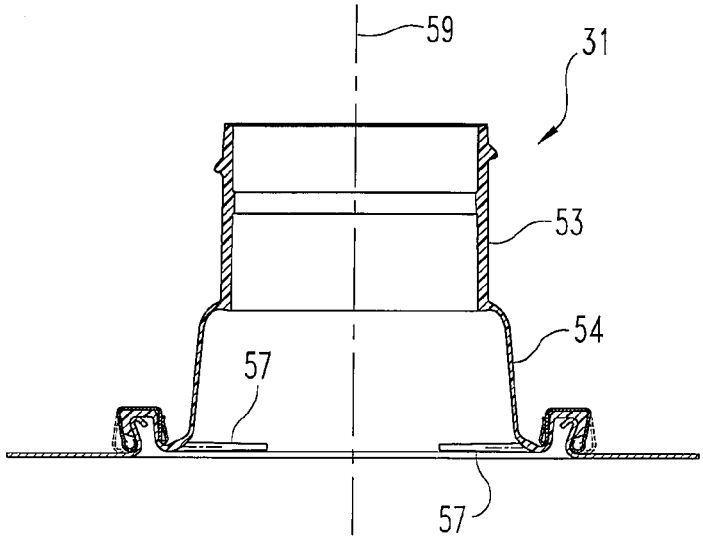
FIG. 19 is an exploded view of the FIG. 18 closure assembly showing the removal of a tear-out diaphragm.

However, an added benefit is realized when the closure body associated with the "directional" spout 31 is configured with the illustrated and disclosed venting ears 57. With reference first to FIGS. 19 and 20, when the spout 31 is extended, the ears 57 flip from vertical to horizontal and cooperate to define central flow opening 77 and a plurality of outward vent openings 78. This basic venting concept or design is disclosed in U.S. Pat. No. 4,618,078, issued Oct. 12, 1996, to Hamman et al.

When the spout 31 is flexed in a direction to achieve a desired orientation, see FIG. 21, some of the venting ears 57, specifically those closest to the direction of flexing, move from horizontal in the direction of vertical, but do not achieve a complete vertical orientation. The extent or degree of travel towards the vertical orientation is controlled by the amount or degree of flexing of spout 31, pivoting at thicker wall portion 76. As some of the venting ears pivot back towards vertical, the size and shape of central flow opening 77 changes. The cross sectional area increases and the generally circular shape becomes more oval, though only slightly, see FIG. 22. The vent opening 78 on the side with the deflected venting ears opens up, but pouring from that side does not require venting. Before, see FIG. 19, dispensing could occur from any direction and thus vent openings had to be provided around the entire central flow opening 77. Now that the flow is directional, only vent openings on the opposite or top side are required for "anti-glug" dispensing.

Figure 23:
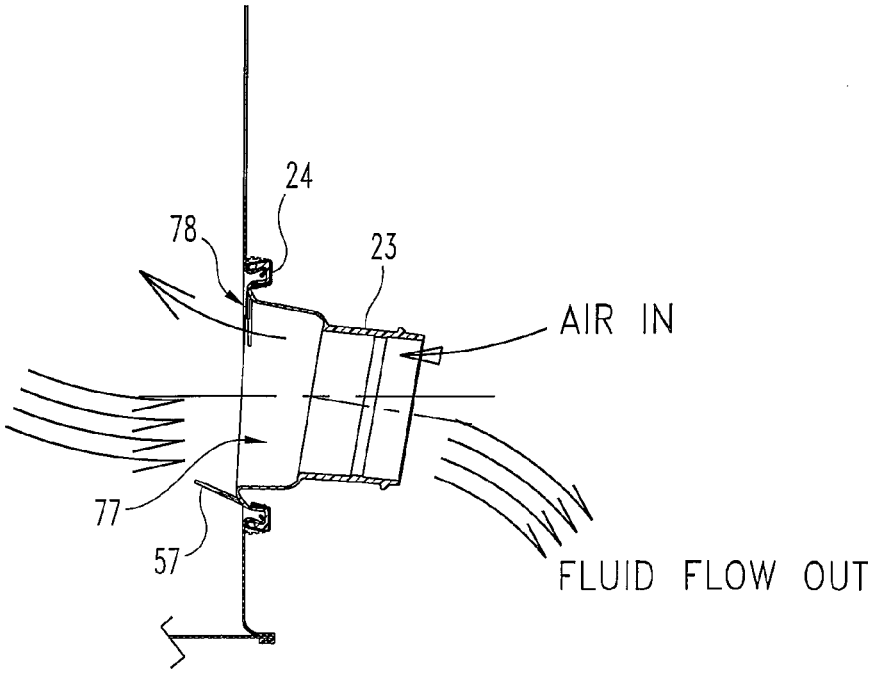
FIG. 23 is a front elevational view, in full section, of the FIG. 21 closure body with the corresponding container tilted into a dispensing orientation so as to illustrate the air and fluid flows.
Figure 24:
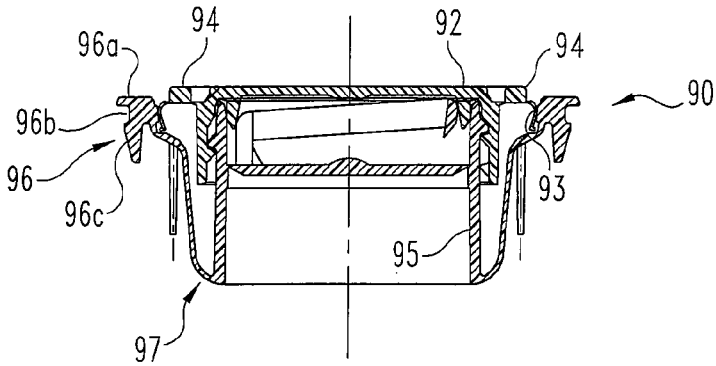
FIG. 24 is a front elevational view, in full section, of a closure assembly according to another embodiment of the present invention.
Figure 25:
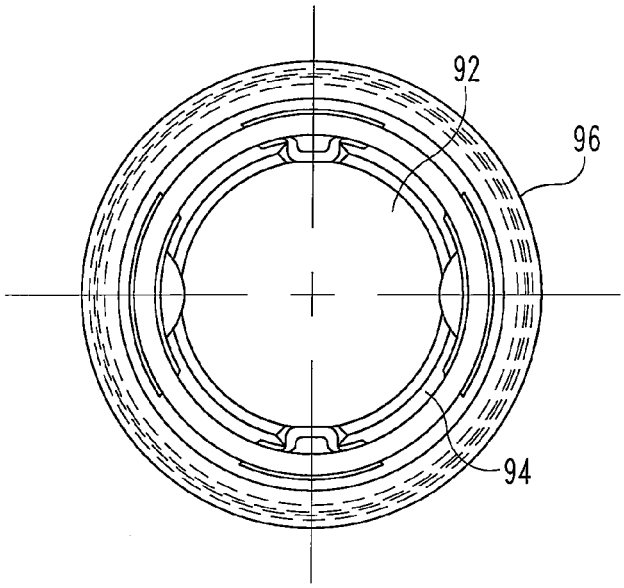
FIG. 25 is a top plan view of the FIG. 24 closure assembly.
Figure 26:
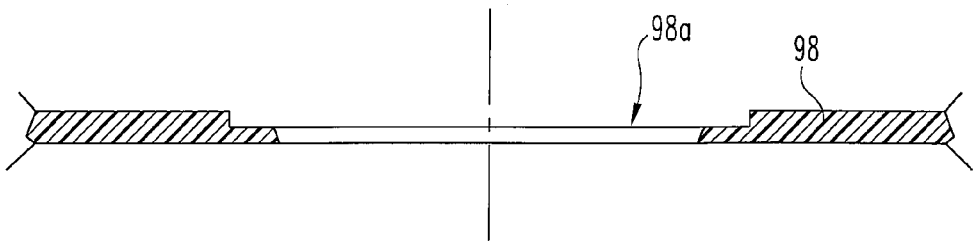
FIG. 26 is a partial, front elevational view, in full section, of a plastic container opening for receipt of the FIG. 24 closure assembly.
Figure 27:
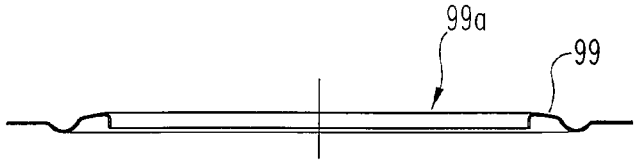
FIG. 27 is a partial, front elevational view, in full section, of a metal container opening for receipt of the FIG. 24 closure assembly.
Figure 28:
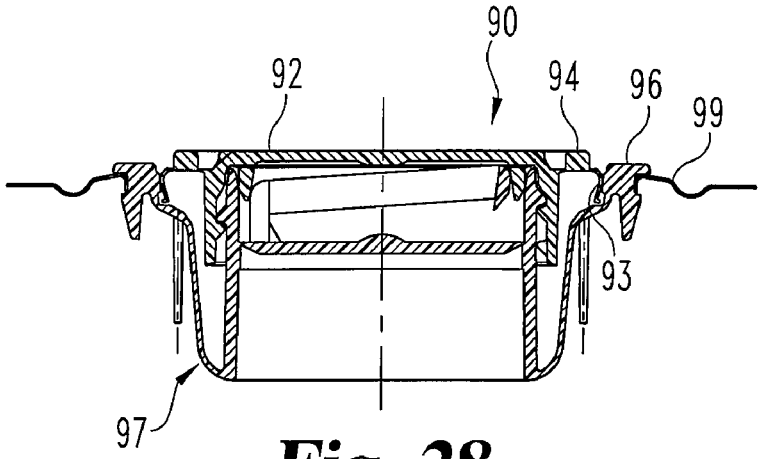
FIG. 28 is a front elevational view, in full section, of the FIG. 24 closure assembly, as installed into the FIG. 27 container opening.
Figure 29:
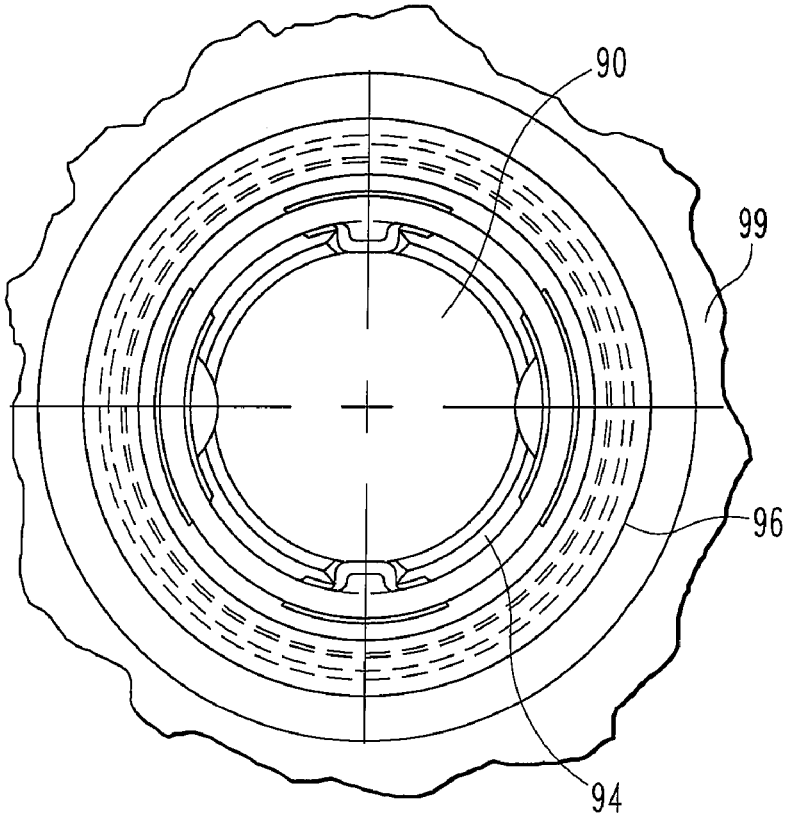
FIG. 29 is a top plan view of the FIG. 28 assembly.

Referring now to FIG. 23, it will be seen that flow out of the lower half of the spout 31 does not require vent openings 78 on that same side. So long as vent openings 78 are provided above the exiting flow, i.e., on the opposite side of the spout 31, the dispensing flow will not glug. While all of the benefits of using a closure assembly with venting ears are still achieved by the present invention, the added benefit of smoother and faster exiting (i.e., dispensing) flow is provided by manipulation of the venting ears and having a central flow opening with a larger cross sectional area.

Referring now to FIGS. 24-32, other closure assembly-container embodiments are illustrated. The intent with FIGS. 24-32 is to disclose and describe other plastic and metal container options when either a friction fit closure assembly 90 or a screw-on closure assembly 91 is being used. Closure assembly 90 is virtually identical to closure assembly 20 except for the elimination of metal retainer 24 and changing the shape and configuration of the outer lip 28. Otherwise, the closing cap 92 is identical to closing cap 23, including all structural features, materials, dimensions, and relationships for the cap body, the bail handles, and flap. Flap 93 is identical to flap 69 and is initially folded and tucked into position in substantially the same way as flap 69. Flap 93 also deploys in the same way as flap 69 when the bail handle or handles 94 are lifted as part of the process to extend the spout 95 from its nested orientation.

The annular outer lip 96 of closure body 97 is configured with a friction fit shape having a flange portion 96*a*, recessed annular channel 96*b*, and depending, tapered annular wall 96*c*. This form of lip 96 is suitable for an axially forced-in (or inserted), friction fit into plastic container 98 opening 98*a* (see FIG. 26). This same style of lip 96 is suitable for an axially forced-in (or inserted) friction fit into metal container 99 opening 99*a* (see FIGS. 27-29).

Opening 98*a* is generally circular and includes a form and shape that tightly and securely receives lip 96 with a snap-in fit assembly. The tapered form of annular wall 96*c* facilitates the axial insertion of the closure body 97. Opening 99*a* is generally circular and includes a form and shape that tightly and securely receives lip 96 with a snap-fit assembly. The tapered form of annular wall 96*c* facilitates the axial insertion of the closure body 97.

Figure 30:
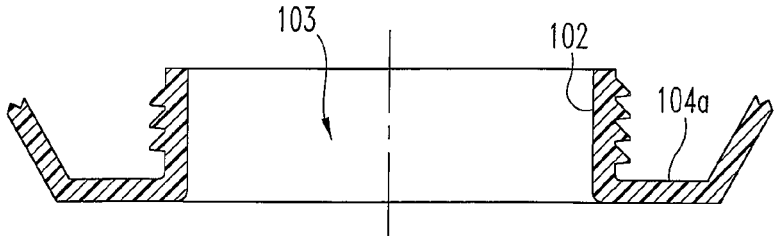
FIG. 30 is a partial, front elevational view, in full section, of a plastic container opening for receipt of a closure assembly according to the present invention.
Figure 31:
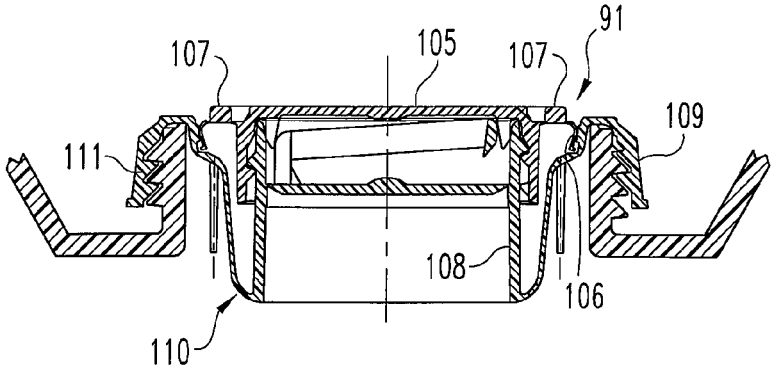
FIG. 31 is a front elevational view, in full section, of a closure assembly, according to the present invention, as assembled onto the FIG. 30 container, by threaded engagement.
Figure 32:
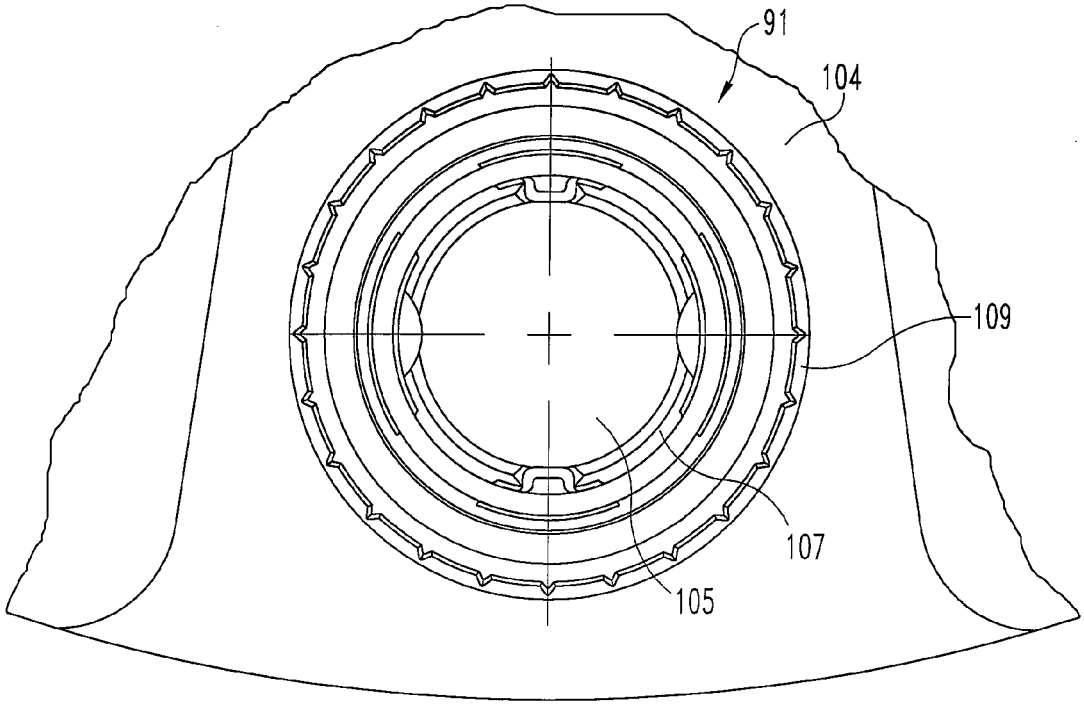
FIG. 32 is a top plan view of the FIG. 31 assembly.
Figure 33:
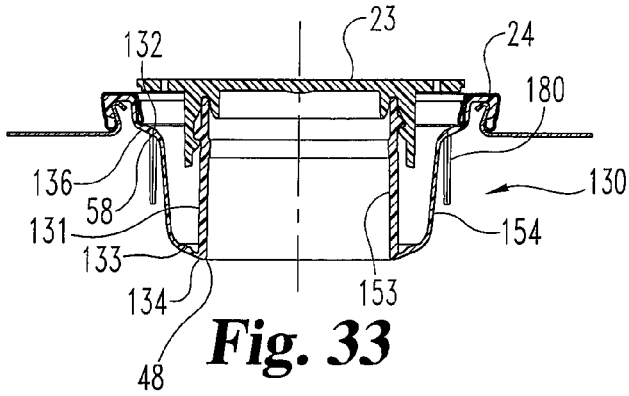
FIG. 33 is a front elevational view, in full section, of a closure assembly as assembled to a raised outlet of a container, according to another embodiment of the present invention.
Figure 34:
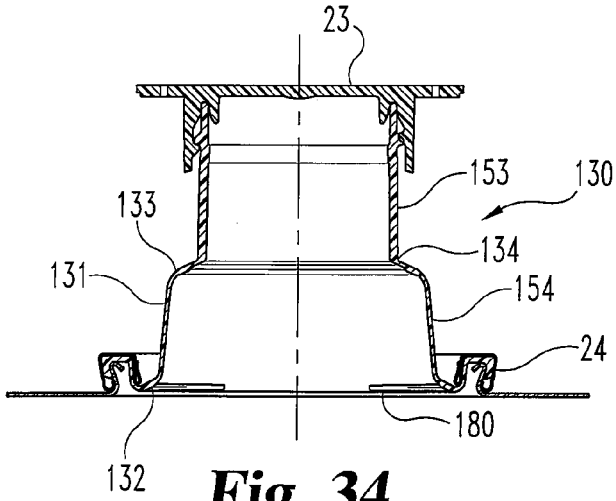
FIG. 34 is a front elevational view, in full section, of the FIG. 33 closure assembly with the spout portion extended.
Figure 35:
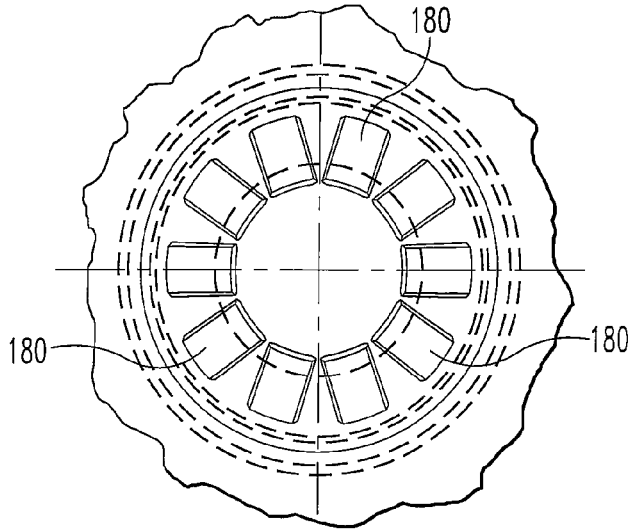
FIG. 35 is a bottom plan view of the extended configuration of FIG. 34 showing the individual venting ears.

Referring now to FIGS. 30, 31, and 32, closure assembly 91 is constructed and arranged to thread onto a raised (plastic), externally-threaded outlet wall 102 that defines dispensing opening 103. The container end 104 is formed with a recessed panel 104*a* so that the closure assembly 91, once applied, will be substantially flush with the outer surface of the container end 104.

Closure assembly 91 is virtually identical to closure assembly 20 except for the elimination of metal retainer 24 and changing the shape and configuration of the outer lip 28. Otherwise, the closing cap 105 is identical to closing cap 23, including all structural features, materials, dimensions and relationships for the cap body, the bail handles, and flap. Flap 106 is identical to flap 69 and is initially folded and tucked into position in substantially the same way as flap 69. Flap 106 also deploys in the same way as flap 69 when the bail handle or handles 107 are lifted as part of the process to extend the spout 108 from its nested orientation.

The annular outer lip 109 of closure body 110 is configured with an internally-threaded, depending annular wall 111. The threaded wall 111 is constructed and arranged to tightly and securely thread onto outlet wall 102 (see FIG. 31).

Referring now to FIGS. 33-37, another embodiment of a directional spout 131 of a closure assembly 130 is illustrated. Included as a part of closure assembly 130 are closing cap 23 and retainer 24. Spout 131 includes an inner, generally cylindrical section 153 and an outer, frustoconical section 154. While spout 31 includes a single, thicker wall portion or annular band 76 as part of the frustoconical section 54, spout 131 includes two separate and spaced-apart thicker portions 132 and 133. Spout 31 has been described as including an inner, generally cylindrical section 53 and an outer, frustoconical section 54. These section descriptions are based on the primary geometric shape of each section. The spout 31 structure also includes an invertible fold 48 and a second fold 58. Fold 48 is generally regarded as the dividing line between sections 53 and 54. Based on this explanation and the corresponding drawings, the frustoconical section 154 of spout 131 (as well as section 54 of spout 31) includes a first transition region 134 that separates section 153 from the frustoconical body 135. A second transition region 136 is located at fold 58. The overall construction of spout 131 is essentially the same as spout 31 except for the addition of a second, thicker wall portion 133. Similarly, closure assembly 130 is essentially the same as closure assembly 20, except for spout 131.

Figure 22:
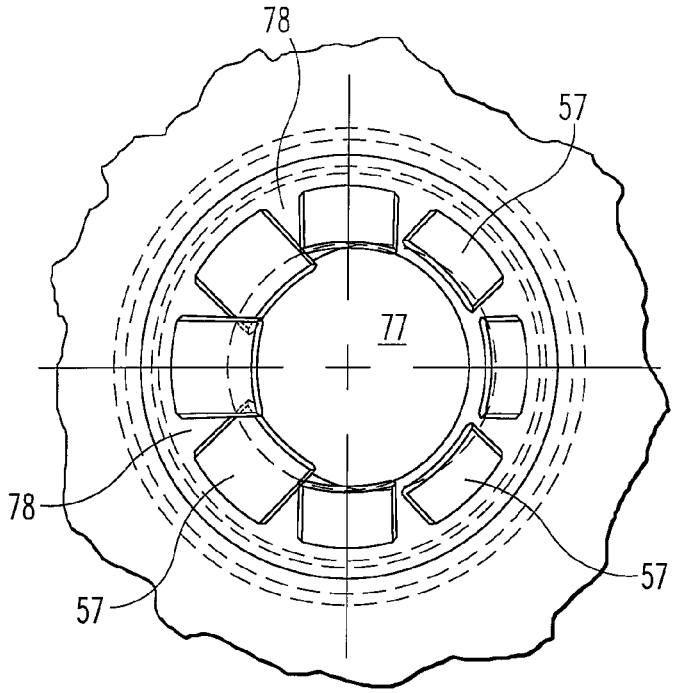
FIG. 22 is a complete bottom plan view of the entire FIG. 1 closure body showing the orientation of the venting ears when the spout is extended.
Figure 36:
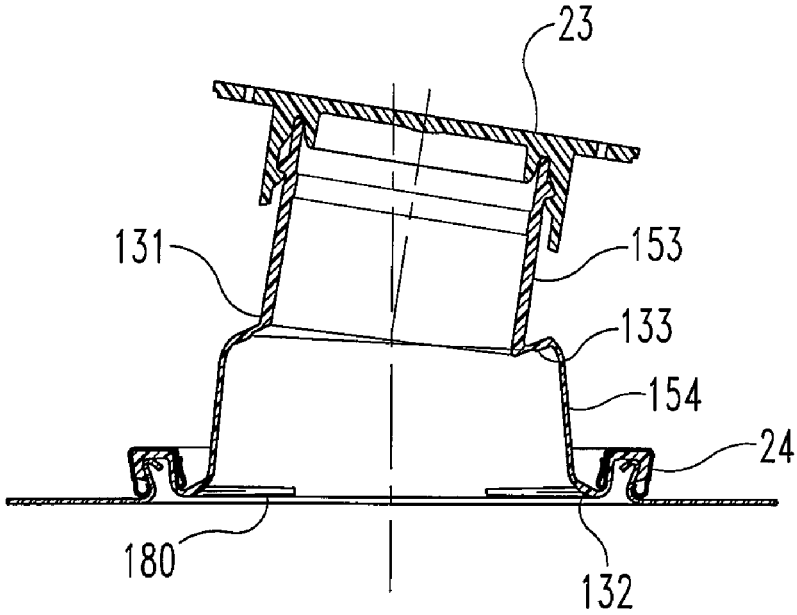
FIG. 36 is a front elevational view, in full section, of the FIG. 33 closure assembly as extended and deflected using a first thicker band portion.
Figure 37:
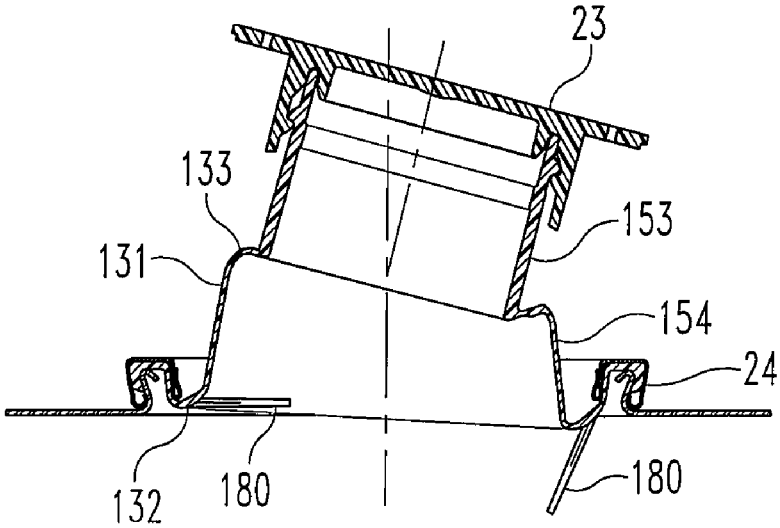
FIG. 37 is a front elevational view, in full section, of the FIG. 33 closure assembly as extended and deflected using both first and second thicker band portions.
Figure 38:
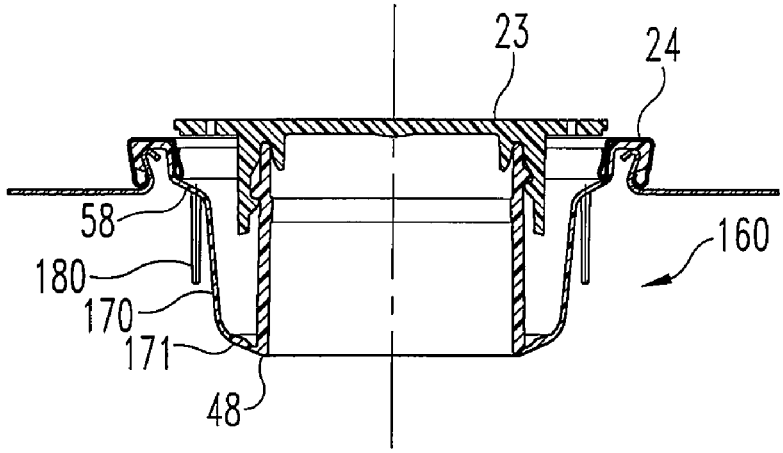
FIG. 38 is a front elevational view, in full section, of a closure assembly as assembled to a raised outlet of a container, according to another embodiment of the present invention.
Figure 39:
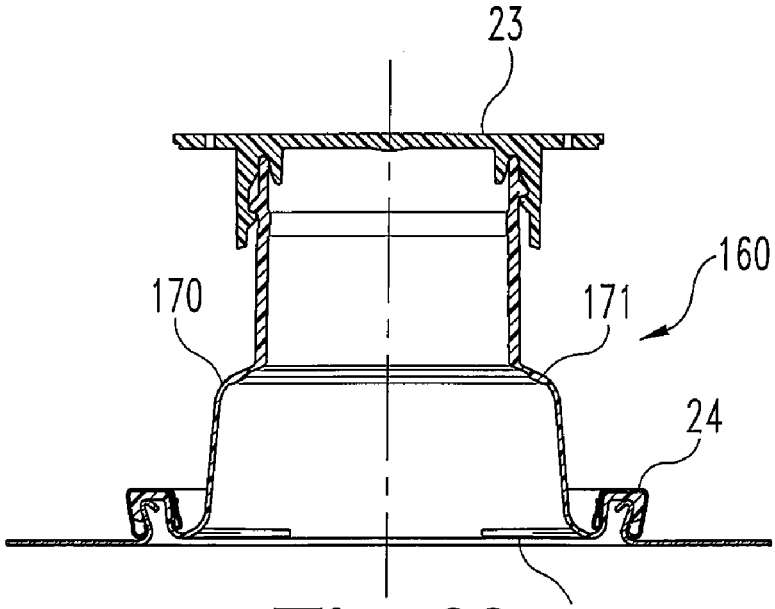
FIG. 39 is a front elevational view, in full section, of the FIG. 38 closure assembly in an extended condition.
Figure 40:
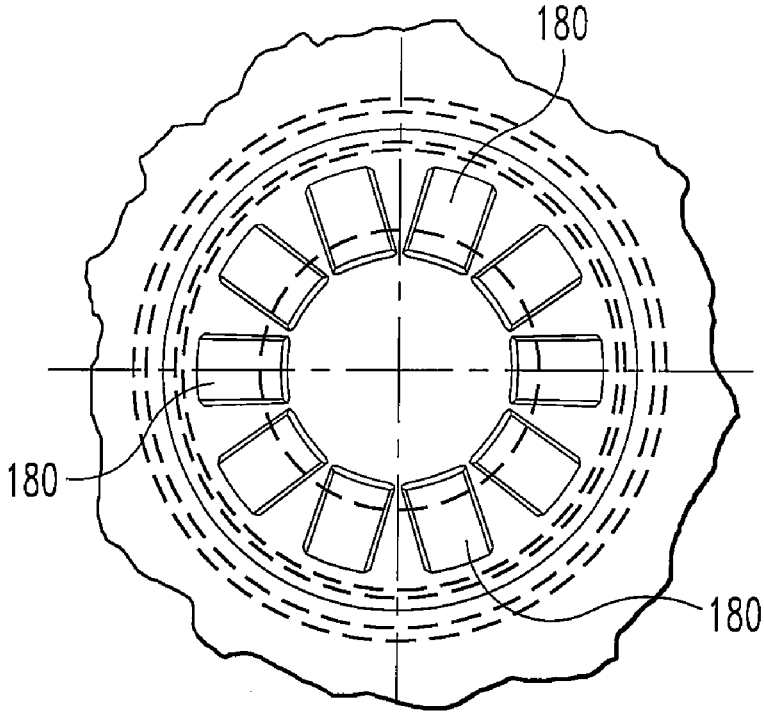
FIG. 40 is a bottom plan view of the FIG. 39 closure assembly, as extended, showing the individual venting ears.
Figure 41:
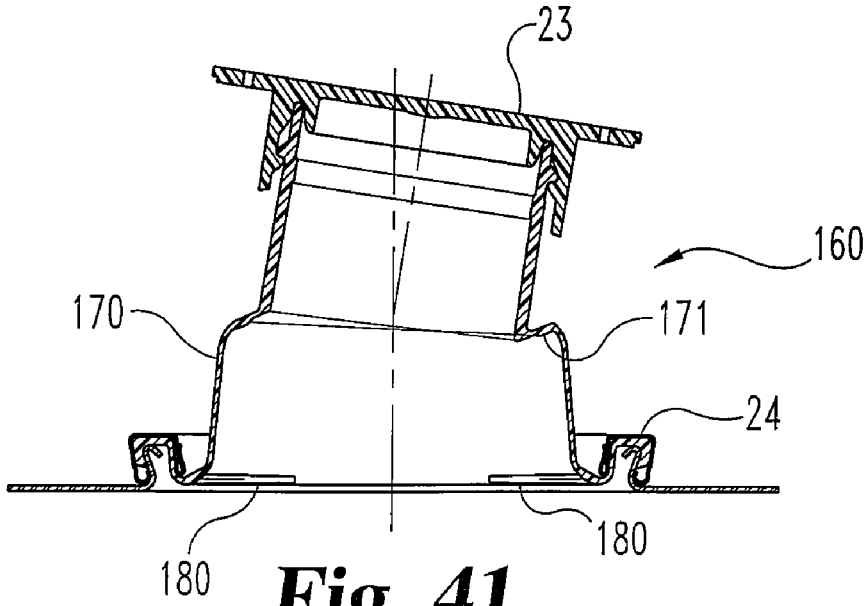
FIG. 41 is a front elevational view, in full section, of the FIG. 38 closure assembly, as deflected using a thicker band portion.

The thicker wall portion 76 of spout 31, now identified as thicker portion 132 of spout 131, is located at the second transition region 136. The additional thicker portion 133 of spout 131 is located at the first transition region 134. The spout deflection is based on placing the bend line through thicker wall portion 76 is illustrated in FIGS. 21-23. The deflection of only section 153 independently of the entire spout 131 is illustrated in FIG. 36. This deflection is based on placing the bend line through thicker wall portion 133. The combined deflection of the spout 131 and of section 153 is illustrated in FIG. 37. While deflection by way of portion 132 affects both sections 153 and 154, deflection by way of portion 133 only affects section 153.

Creating a spout structure with two separate thicker portions or annular bands 132 and 133 provides a greater degree of versatility in terms of the spout deflections and thus the corresponding dispensing orientations. Portion 132 is essentially the same as thicker wall portion 76 in form, fit, function, dimensions, material, and location. Portions 132 and 133 are essentially the same except for their locations and orientations. Portion 133 is positioned in the vicinity of the invertible fold 48.

The embodiment of FIGS. 33-37 includes a change to the number and style of venting ears. The venting ears 57 of closure assembly 20 are replaced in closure assembly 130 with venting ears 180. In lieu of eight (8) venting ears 57 of a slightly wider construction, closure assembly 130 uses ten (10) venting ears 180 of a slightly narrower construction. Venting ears 180 are still equally-spaced and located at fold 58 where the second transition region 136 coexists.

Referring now to FIGS. 38-41, another embodiment of a directional spout 170 of a closure assembly 160 is illustrated. The single thicker wall portion 76 of spout 31 has been moved to a different location as part of the new closure assembly illustrated in FIGS. 38-41. This relocated thicker wall portion is now represented by thicker wall portion or annular band 171. The directional properties of portion 171 are essentially the same as those of portion 76 and thus spout 170 behaves in a manner that is similar to spout 31. However, the change in location of thicker wall portion 171, as compared to the location of portion 76, creates different dynamics in terms of what portions of the spout experience a deflection and how the dispensing orientation changes. Closure assembly 160 includes ten (10) venting ears 180 that are constructed and arranged the same as venting ears 180 on closure assembly 130.

With regard to the use of a thicker wall portion or annular ("memory") band as part of a directional spout, three primary embodiments have been illustrated and described. The only differences between these three embodiments are found in the construction of the spout. To briefly describe the differences, it should be sufficient to identify the number and locations of the thicker wall portions that are used as "memory band" structures. Spout 31 includes only one portion 76 that is located at fold 58. Spout 131 includes two portions 132 and 133. Portion 132 is located at fold 58. Portion 133 is located adjacent fold 48. Spout 170 includes only one portion 171 that is located adjacent fold 48.

Figure 42:
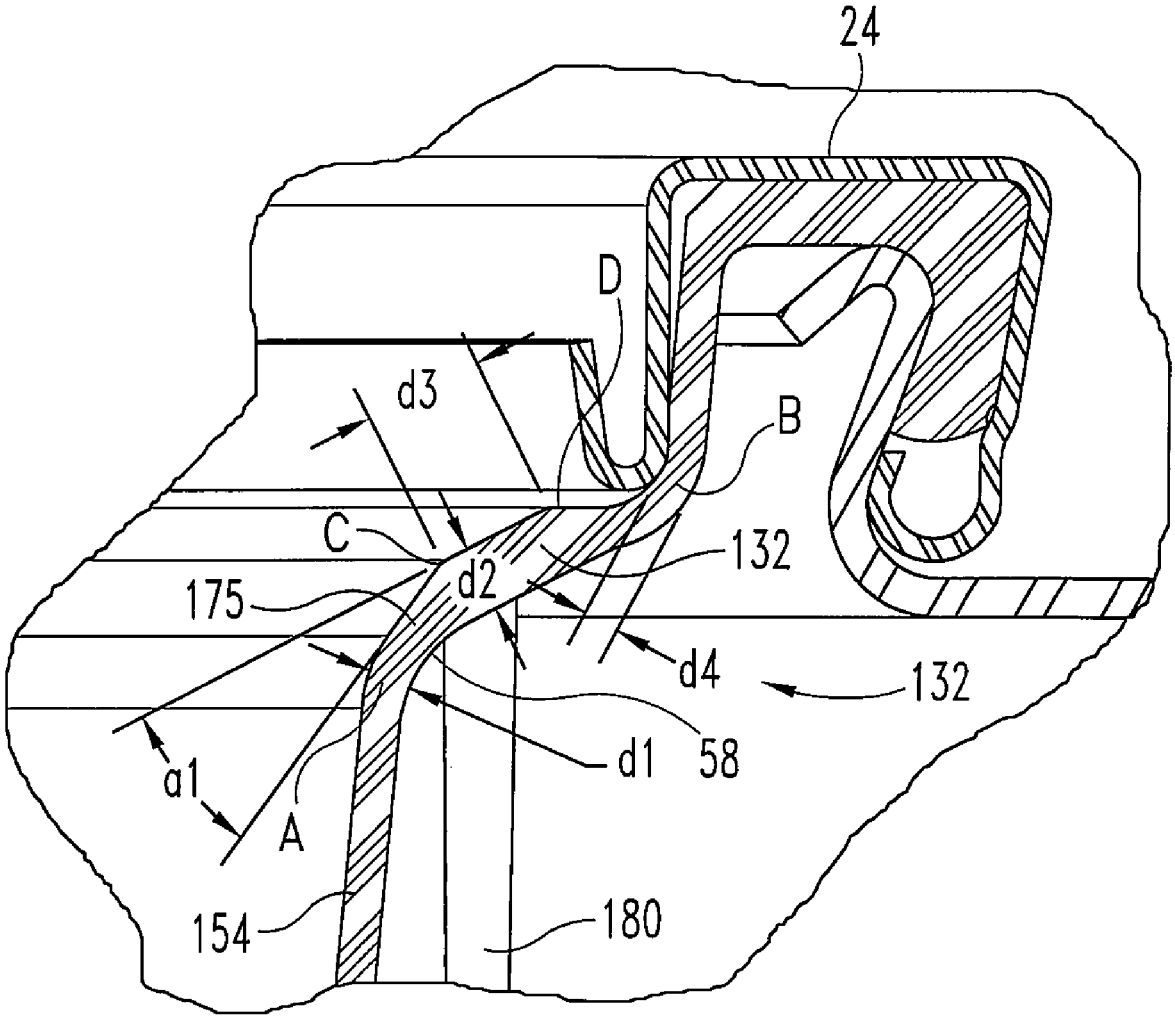
FIG. 42 is an enlarged detail of the thicker band portion of FIG. 41.

Each thicker wall portion 76, 132, 133, and 171 has essentially the same construction in terms of material, shape, and dimensions. Some of the specifics will now be described using FIG. 42 and wall portion 132 as the representative example. The wall thickness of the frustoconical body 154 is substantially uniform until reaching the vicinity of point A. Portion 175 begins at this location and the wall thickness increases. Point A also signifies the start of bend 58. The width of portion 175 gradually increases until point C is reached and the width is generally uniform between points C and D. From point D to point B the thickness gradually decreases. Points A and B of FIG. 42 are generally the same as Points A and B of FIG. 11. Thickness dimension d1 is approximately 0.025 inches at the bend (Point A). Thickness dimension d2 is approximately 0.041 inches between Points C and D. Length dimension d3 is approximately 0.075 inches. Thickness dimension d4 at Point B is approximately 0.023 inches. Angle a1 measures approximately 30 degrees.

As noted, each of the three primary embodiments disclosed herein, including closure assemblies 20, 130, and 160, includes a plurality of venting ears (or tabs) 57 or 180. Two embodiments of venting ears are disclosed. One embodiment, shown as part of closure assembly 20, is illustrated in greater detail in FIG. 20. As shown, there are eight (8) venting ears 57 and each venting ear 57 has a width dimension that is sufficient for the corners of adjacent ears to overlap when the spout 31 is extended and the venting ears 57 flip over to a generally horizontal orientation, as illustrated in FIG. 20. This number and style of venting ears 57 is acceptable for use as part of each of the other two spout structures (spout 131 and spout 170). However, each of these other two spouts is illustrated with a different series of venting ears 180. The venting ears 180 used on spout 131 and on spout 170 are smaller in their width dimension and the number of venting ears is increased from eight (8) to ten (10), see FIGS. 35, 40 and 46. However, when the corresponding spout is extended and the venting ears 180 flip to a generally horizontal orientation, there is essentially no noticeable contact between adjacent ears and there is no corner overlap as found with the other style of venting ears, as illustrated in the other venting ear embodiment. Importantly, either venting ear embodiment is suitable for use with any of the three spout embodiments and vice versa. However, it has been learned that when one or more thicker wall portions are included as a part of the spout for the "memory band" capability, the second venting ear 180 embodiment is preferred. This is the embodiment of smaller width ears and with a larger number of ears, but without any corner overlap by adjacent ears 180.

Figure 43:
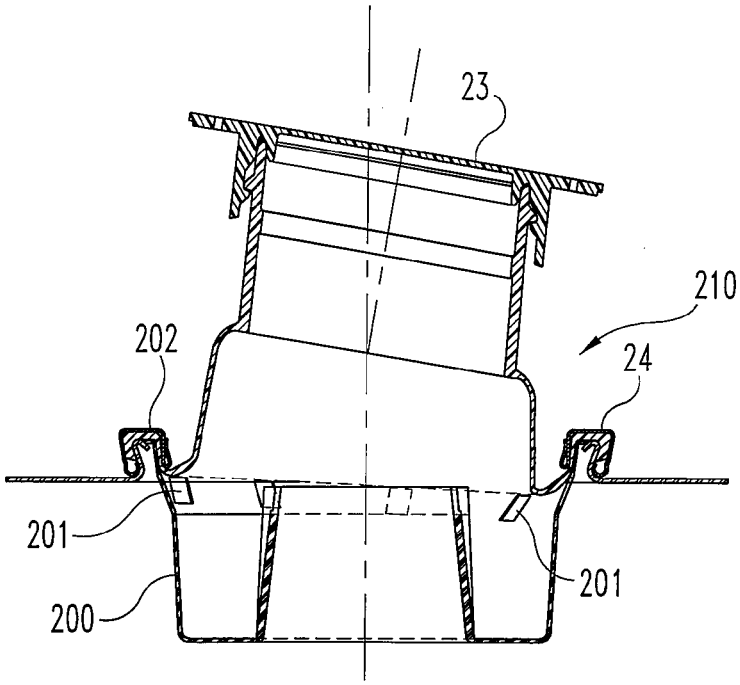
FIG. 43 is a front elevational view, in full section, of a closure assembly in an extended and deflected orientation according to another embodiment of the present invention.
Figure 44:
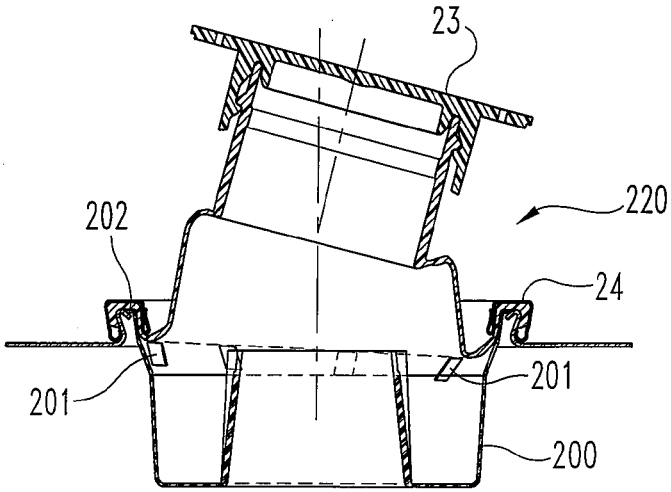
FIG. 44 is a front elevational view, in full section, of a closure assembly in an extended and deflected orientation according to another embodiment of the present invention.
Figure 45:
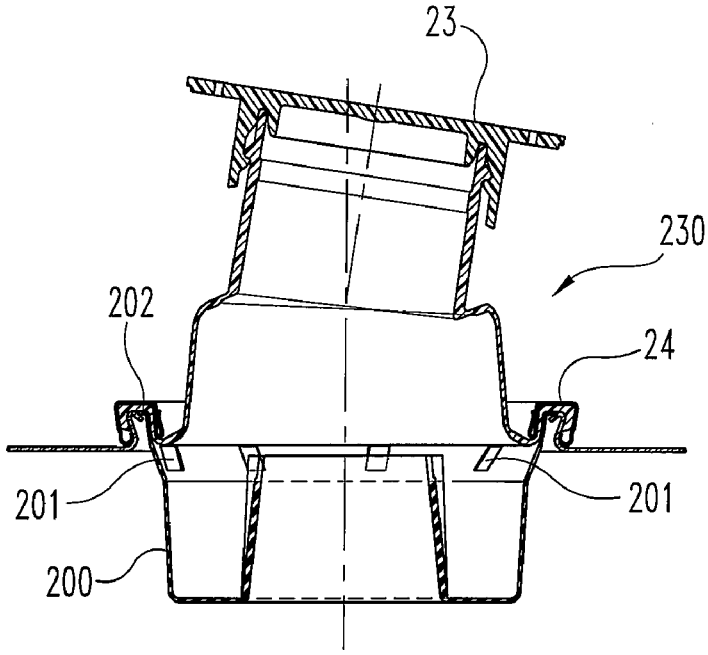
FIG. 45 is a front elevational view, in full section, of a closure assembly in an extended and deflected orientation according to another embodiment of the present invention.

Venting ears, such as ears 57 or ears 180, represent one venting option for closure assemblies such as for the three primary embodiments disclosed herein. However, a cup-style vent can also be used with spouts that include thicker wall portions for deflection (i.e., for functioning as a "memory band" feature). FIGS. 43, 44, and 45 show each of the three primary embodiments with a cup-style vent 200 instead of using venting ears 57 or 180 as the structure for venting while dispensing the contents of the container. More specifically, closure assembly 210 is the same as closure assembly 20, except for replacing venting ears 57 with cup-style vent 200. Closure assembly 220 is the same as closure assembly 130, except for replacing venting ears 180 with cup-style vent 200. Closure assembly 230 is the same as closure assembly 160, except for replacing venting ears 180 with cup-style vent 200.

The cup-style vent 200 has an annular, unitary form and includes a plurality of spaced-part openings 201 for air entry. The vent 200 includes an outer lip 202 that is assembled to the raised opening of the container and secured thereto by use of the retainer 24. This causes the vent 200 to essentially remain fixed in position and fixed in orientation regardless of any deflection of the spout for any of the three primary embodiments.

Figure 46:
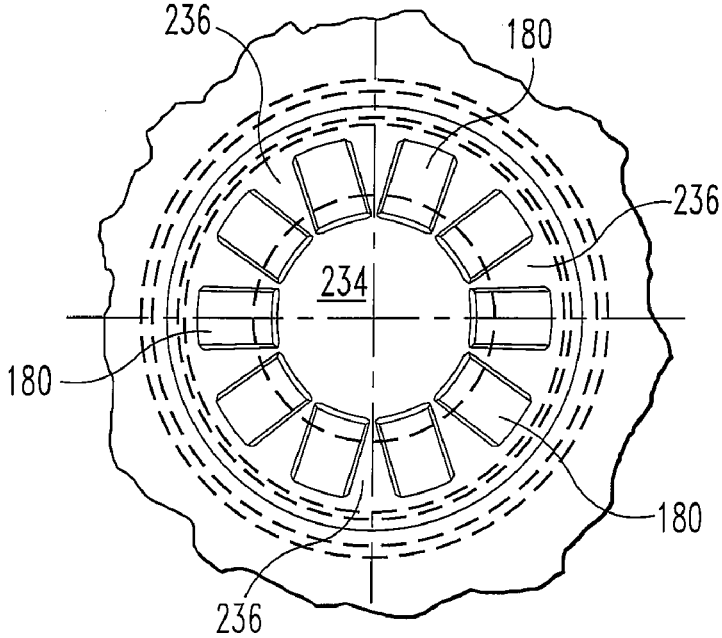
FIG. 46 is a bottom plan view of the venting ear configuration for an extended spout using ten equally-spaced venting ears.

Referring now to FIG. 46, additional details of the venting ears 180 are disclosed and described. Each venting ear 180 (ten 10)) total is approximately 0.05 inches in thickness, approximately 0.36 inches wide, and approximately 0.48 inches in length. Adjacent ears 180, although not in contact with each other, still define center flow opening 234 and help to define generally triangular venting openings 236. This size and number of venting ears 180 is constructed and arranged for a standard 2⅜ inch (63 mm) container opening.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A closure assembly for a container, the container including outlet means defining a dispensing opening, said closure assembly comprising:

a closure body including a nestable and extendable spout, said spout having a first section, a second section, and an invertible fold between said first and second sections, said first section defining an outlet opening;

a closing cap constructed and arranged for assembly to said spout for closing off said outlet opening;

means for assembling said closure body to said outlet means;

wherein said second section includes a wall having a first portion with a first wall thickness and a first band portion with a second wall thickness, wherein the second wall thickness is greater than said first wall thickness, said first band portion being constructed and arranged for enabling said spout to maintain a selected orientation upon deflecting said spout into said selected orientation for directional discharge of container contents; and wherein said second section wall further includes a second band portion with a wall thickness that is greater than said first wall thickness, said second band portion being located adjacent said invertible fold.

2. The closure assembly of claim 1 wherein said closure body includes a plurality of venting ears.

3. The closure assembly of claim 2 wherein said plurality of venting ears are joined to said second section.

4. The closure assembly of claim 3 wherein the closure body is a unitary, molded plastic component that includes a removable diaphragm positioned interior to said first section and constructed and arranged to close off said outlet opening.

5. The closure assembly of claim 4 which further includes a gripping member joined to said diaphragm, said gripping member having a free state wherein a portion of said gripping member extends above an upper edge of said nestable and extendable spout.

6. The closure assembly of claim 5 wherein said closing cap is constructed and arranged to receive the upper edge of said nestable and extendable spout and to push said gripping member portion down into said first section.

7. The closure assembly of claim 6 wherein said closing cap includes a pair of bail handles, each bail handle being joined to a closing cap body by a corresponding hinge portion.

8. The closure assembly of claim 7 wherein said bail handles are connected to said closing cap body by a plurality of frangible elements.

9. The closure assembly of claim 1 which further includes an annular vent member attached to said outlet means.

10. The closure assembly of claim 9 wherein said spout moves independently of said vent member during deflection of said spout.

11. In combination:

a container including outlet means defining a dispensing opening; and a closure assembly constructed and arranged for connection with said outlet means, said closure assembly comprising:

a closure body including a nestable and extendable spout, said spout having a first section, a second section, and an invertible fold between said first and second sections, said first section defining an outlet opening;

a closing cap constructed and arranged for assembly to said spout for closing off said outlet opening;

means for assembling said closure body to said outlet means;

wherein said second section includes a wall having a first wall portion with a first wall thickness and a first band portion with a second wall thickness, wherein the second wall thickness is greater than said first wall thickness, said first band portion being constructed and arranged for enabling said spout to maintain a selected orientation upon deflecting said spout into said selected orientation for directional discharge of container contents; and wherein said second section wall further includes a second band portion with a wall thickness that is greater than said first wall thickness, said second band portion being located adjacent said invertible fold.

12. The combination of claim 11 wherein said closure body includes a plurality of venting ears.

13. The combination of claim 12 wherein said plurality of venting ears are joined to said second section.

14. The combination of claim 13 wherein the closure body is a unitary, molded plastic component that includes a removable diaphragm positioned interior to said first section and constructed and arranged to close off said outlet opening.

15. The combination of claim 14 which further includes a gripping member joined to said diaphragm, said gripping member having a free state wherein a portion extends above an upper edge of said nestable and extendable spout.

16. The combination of claim 15 wherein said closing cap is constructed and arranged to receive the upper edge of said nestable and extendable spout and to push said gripping member portion down into said first section.

17. The closure assembly of claim 11 which further includes an annular vent member attached to said outlet means.

18. The closure assembly of claim 17 wherein said spout moves independently of said vent member during deflection of said spout.

19. A closure body for use with a dispensing opening of a container comprises:

a generally cylindrical section;

a cooperating frustoconical section;

an invertible fold positioned between said generally cylindrical section and said frustoconical section, said closure body being constructed and arranged to be oriented in either a nested condition or an extended condition, said generally cylindrical section defining an outlet opening and wherein said frustoconical section includes a wall having a first wall thickness and a first band portion with a second wall thickness, wherein said second wall thickness is greater than said first wall thickness, said first band portion being constructed and arranged for enabling said closure body to maintain a selected directional orientation upon deflecting said closure body into said selected directional orientation; and wherein said frustoconical section wall further includes a second band portion with a wall thickness that is greater than said first wall thickness, said second band portion being located adjacent said invertible fold.

20. A closure assembly for a container, the container including outlet means defining a dispensing opening, said closure assembly comprising:

a closure body including a nestable and extendable spout, said spout having a first section, a second section, and a transition region including an invertible fold, said transition region being located between said first and second sections, said first section defining an outlet opening;

a closing cap constructed and arranged for assembly to said spout for closing off said outlet opening;

means for assembling said closure body to said outlet means; and wherein said second section includes a wall having a first portion with a first wall thickness and wherein said transition region includes a band portion adjacent said first section with a second wall thickness, wherein the second wall thickness is greater than said first wall thickness, said band portion being constructed and arranged for enabling said spout to maintain a selected orientation upon deflecting said spout into said selected orientation for directional discharge of container contents.

* * * * *